US009648718B2

(12) United States Patent
Kato

(10) Patent No.: US 9,648,718 B2
(45) Date of Patent: May 9, 2017

(54) PLASMA EMISSION DEVICE, AND ELECTROMAGNETIC WAVE GENERATOR USED THEREIN

(71) Applicant: TOSHIBA HOKUTO ELECTRONICS CORPORATION, Asahikawa-shi, Hokkaido (JP)

(72) Inventor: Naoya Kato, Asahikawa (JP)

(73) Assignee: TOSHIBA HOKUTO ELECTRONICS CORPORATION, Asahikawa-Shi (JP)

( * ) Notice: Subject to any disclaimer, the term of this patent is extended or adjusted under 35 U.S.C. 154(b) by 184 days.

(21) Appl. No.: 14/592,188

(22) Filed: Jan. 8, 2015

(65) Prior Publication Data

US 2015/0123537 A1 May 7, 2015

Related U.S. Application Data

(63) Continuation of application No. PCT/JP2013/004222, filed on Jul. 8, 2013.

(30) Foreign Application Priority Data

Jul. 9, 2012 (JP) ..... 2012-153631

(51) Int. Cl.
*H05H 1/46* (2006.01)
*H01J 65/04* (2006.01)

(52) U.S. Cl.
CPC ..... *H05H 1/46* (2013.01); *H01J 65/044* (2013.01)

(58) Field of Classification Search
None
See application file for complete search history.

(56) References Cited

U.S. PATENT DOCUMENTS 3,739,225 A * 6/1973 Mims ..... H01J 23/10 219/761
3,794,879 A * 2/1974 Edwards ..... H01J 23/10 219/757

(Continued)

FOREIGN PATENT DOCUMENTS

CN 1319113 C 5/2007
EP 0 871 196 A1 10/1998

(Continued)

OTHER PUBLICATIONS

Master Dissertation; University of Electronic Science and Technology of China; Jul. 15, 2011.

*Primary Examiner* — Douglas W Owens
*Assistant Examiner* — Srinivas Sathiraju
(74) *Attorney, Agent, or Firm* — Foley & Lardner LLP

(57) ABSTRACT

A plasma emission device in an embodiment includes: an electromagnetic wave generator; a waveguide transmitting an electromagnetic wave emitted from the electromagnetic wave generator, an antenna receiving the electromagnetic wave transmitted through the waveguide; an electromagnetic wave focuser which is irradiated with the electromagnetic wave from the antenna; and an electrodeless bulb disposed in the electromagnetic wave focuser. A light-emitting material filled in the electrodeless bulb is excited by the electromagnetic wave focused by the electromagnetic wave focuser to perform plasma emission. The electromagnetic wave generator includes a cathode part and an anode part. A maximum output efficiency of the electromagnetic wave to be generated with an input power of 700 W or less is 70% or more.

15 Claims, 17 Drawing Sheets

(56) References Cited

U.S. PATENT DOCUMENTS 3,936,766 A * 2/1976 Staats ..... H01J 23/48 315/39.53
4,179,639 A * 12/1979 Derby ..... H01J 23/22 228/115
4,988,922 A * 1/1991 Shoda ..... H05B 41/24 315/207
5,767,749 A 6/1998 Shon et al.
6,680,576 B2 * 1/2004 Jeon ..... H01J 23/005 315/112
6,720,733 B2 * 4/2004 Suzuki ..... H05B 41/24 315/248
6,737,809 B2 5/2004 Espiau et al.
6,922,021 B2 7/2005 Espiau et al.
7,023,137 B2 4/2006 Ishii et al.
7,161,303 B2 1/2007 Park et al.
7,348,732 B2 * 3/2008 Espiau ..... H01J 7/46 313/634
7,358,678 B2 * 4/2008 Espiau ..... H01J 7/46 313/634
7,362,054 B2 * 4/2008 Espiau ..... H01J 7/46 313/634
7,362,055 B2 * 4/2008 Espiau ..... H01J 7/46 313/634
7,362,056 B2 * 4/2008 Espiau ..... H01J 7/46 315/248
7,372,209 B2 5/2008 Espiau et al.
7,391,158 B2 * 6/2008 Espiau ..... H01J 7/46 313/634
7,429,818 B2 * 9/2008 Chang ..... H01J 7/46 313/231.01
7,465,478 B2 * 12/2008 Collins ..... H01J 37/32082 427/490
7,498,747 B2 * 3/2009 Espiau ..... H01J 7/46 313/634
7,609,001 B2 * 10/2009 Small ..... H01J 25/56 315/39.51
7,919,923 B2 * 4/2011 Espiau ..... H01J 7/46 315/248
7,940,007 B2 * 5/2011 Chang ..... H01J 7/46 315/248
8,110,988 B2 * 2/2012 Espiau ..... H01J 7/46 315/248
8,164,265 B2 * 4/2012 Shinogi ..... H05B 41/24 315/248
8,203,272 B2 * 6/2012 Chang ..... H01J 7/46 315/248
8,217,564 B2 7/2012 Odell et al.
8,508,131 B2 * 8/2013 Kim ..... H01J 65/044 315/248
8,878,433 B1 * 11/2014 Fleming ..... H01J 25/587 315/39.3
2002/0011802 A1 1/2002 Espiau et al.
2007/0103649 A1 5/2007 Takada et al.
2007/0151847 A1 7/2007 Lee
2007/0296515 A1 12/2007 Kato et al.
2008/0296508 A1 * 12/2008 Small ..... H01J 23/02 250/393
2009/0023090 A1 * 1/2009 Fujimoto ..... B32B 27/08 430/124.15
2011/0012508 A1 * 1/2011 Leonhardt ..... H01J 23/005 315/39
2011/0117202 A1 * 5/2011 Bourke, Jr. ..... H05B 41/2806 424/490
2012/0293067 A1 * 11/2012 Neate ..... H01Q 1/26 315/34
2013/0193867 A1 * 8/2013 Van Zyl ..... H01J 37/32183 315/240

FOREIGN PATENT DOCUMENTS

JP 09-293456 A 11/1997
JP 2003-045350 A 2/2003
JP 2004-047266 A 2/2004
JP 2004-505429 A 2/2004
JP 2005-085685 A 3/2005
JP 2005-085749 A 3/2005
JP 2007-184274 A 7/2007
JP 2007-335351 A 12/2007
JP 2010-527129 A 8/2010
WO WO-2010/128301 A2 11/2010
WO WO-2012/007714 A1 1/2012

* cited by examiner

PLASMA EMISSION DEVICE, AND ELECTROMAGNETIC WAVE GENERATOR USED THEREIN

CROSS-REFERENCE TO RELATED APPLICATIONS

This application is a continuation of prior International Application No. PCT/JP2013/004222 filed on Jul. 8, 2013, which is based upon and claims the benefit of priority from Japanese Patent Application No. 2012-153631 filed on Jul. 9, 2012; the entire contents of all of which are incorporated herein by reference.

FIELD

Embodiments described herein relate generally to a plasma emission device and an electromagnetic wave generator used therein.

BACKGROUND

Conventionally, a high intensity discharge lamp (HID) such as a high-pressure mercury lamp, a metal halide lamp, a high-pressure sodium lamp or the like has mainly been used for an illumination device required to have a high output such as an illumination fixture installed at a high ceiling of a warehouse, a road illumination, or the like. With an increase in demand for energy saving, the illumination device is also required to save energy. Also in the HID, energy saving is proceeded by increasing efficiency through use of a metal halide lamp equipped with an arc tube made of translucent ceramics (ceramic metal halide lamp) or the like, but is not enough. The ceramic metal halide lamp degrades in intensity with time as with other HIDs and does not have a sufficient lifetime. The ceramic metal halide lamp thus has a disadvantage of high installation cost and maintenance cost.

As a long-lifetime and energy-saving illumination device, LED illumination is attracting attention. The LED illumination uses a light-emitting diode (LED) as a light-emitting source or an excitation source of phosphor. Therefore, the LED illumination has characteristics of less power consumption and a long lifetime of the order of several tens of thousands of hours to a hundred thousand hours. However, the LED illumination is generally widely used for a low-output illumination device but is regarded to be unsuitable for an illumination device required to have high output. In other words, when the LED illumination is made to have high output, its energy conversion efficiency degrades to increase its heat value, resulting in significantly shortened lifetime. When used as the illumination device for a high ceiling, the LED illumination is insufficient also in light distribution luminance.

Apart from the illumination device using an HID, LED or the like, a plasma illumination device having an electrodeless bulb is known. In the plasma illumination device, a light-emitting material filled in the electrodeless bulb is excited by a microwave for plasma emission. The plasma illumination device has, for example, a microwave generator, a microwave focuser to which the microwave generated in the microwave generator is guided, and an electrodeless bulb installed in the microwave focuser. The light-emitting material filled in the electrodeless bulb is excited by the microwave focused by the microwave focuser to the electrodeless bulb to thereby perform plasma emission. The electrodeless plasma illumination has a long lifetime because the light-emitting material filled in the bulb is activated with no physical contact, and is a point light source and therefore an illumination device suitable for light distribution design. However, the conventional plasma illumination device has a drawback that its luminous efficiency with respect to an input power is insufficient, and is therefore required to be improved in luminous efficiency and enhanced in total luminous flux based thereon.

DETAILED DESCRIPTION

Figure 1:
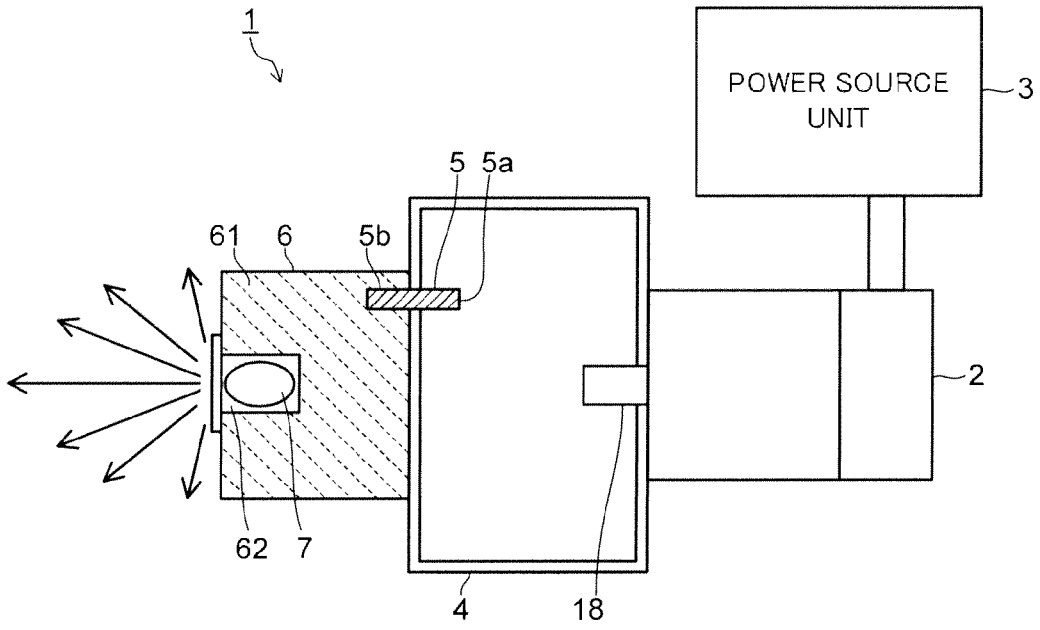
FIG. 1 is a diagram illustrating a schematic configuration of a plasma emission device in a first embodiment.

A plasma emission device in an embodiment includes: an electromagnetic wave generator; a power source unit supplying power to the electromagnetic wave generator, a waveguide transmitting an electromagnetic wave emitted from the electromagnetic wave generator, an antenna receiving the electromagnetic wave transmitted through the waveguide; an electromagnetic wave focuser which is irradiated with the electromagnetic wave from the antenna; and a light emitting unit having an electrodeless bulb disposed in the electromagnetic wave focuser and filled with a light-emitting material therein. The electrodeless bulb plasma-emits (emits light with plasma) by the electromagnetic wave being focused by the electromagnetic wave focuser to excite the light-emitting material. The electromagnetic wave generator includes a cathode part and an anode part surrounding the cathode part, and a maximum output efficiency of the electromagnetic wave to be generated with an input power of 700 W or less in the electromagnetic wave generator is 70% or more.

Hereinafter, a plasma emission device and an electromagnetic wave generator used therein in an embodiment will be described referring to the drawings.

(First Embodiment)

FIG. 1 is a diagram illustrating a schematic configuration of a plasma emission device. The plasma emission device 1 illustrated in FIG. 1 includes an electromagnetic wave generator 2, a power source unit 3 that supplies power to the electromagnetic wave generator 2, a waveguide 4 that transmits an electromagnetic wave emitted from the electromagnetic wave generator 2, an antenna 5 that receives the electromagnetic wave transmitted through the waveguide 4, an electromagnetic wave focuser 6 that is irradiated with the electromagnetic wave from the antenna 5, and a light emitting unit having an electrodeless bulb 7 that is disposed in the electromagnetic wave focuser 6. In the electrodeless bulb 7, a light-emitting material is filled. The electromagnetic wave is focused by the electromagnetic wave focuser 6 to the electrodeless bulb 7 to thereby excite the light-emitting material filled in the electrodeless bulb 7 for plasma emission.

Figure 2:
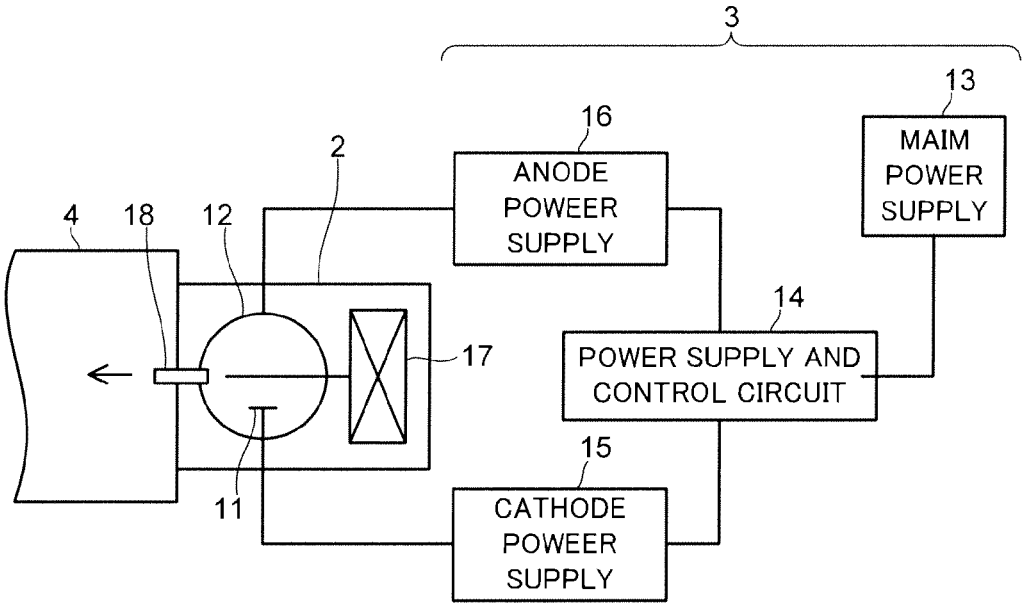
FIG. 2 is a diagram illustrating configurations of an electromagnetic wave generator and a power source unit in the plasma emission device illustrated in FIG. 1.

A configuration of the plasma emission device 1 in the first embodiment will be described. The electromagnetic wave generator 2 includes a cathode part (negative electrode) 11 and an anode part (positive electrode) 12 as illustrated in FIG. 2. The cathode part 11 and the anode part 12 function as an oscillating unit that generates a high frequency electromagnetic wave (hereinafter, described as a microwave). The frequency of the microwave to be generated is preferably 2450±50 MHz that is allocated to an ISM (Industrial Scientific and Medical) band that is an industrial, scientific and medical band not restricted in emission allowable value by the Radio Law by the International Telecommunication Union (ITU).

For example, in a 915±15 MHz band as an ISM band close thereto, the resonant wavelength becomes long (a resonant wavelength at 2450 MHz is 12 cm, whereas the resonant wavelength at 915 MHz is 33 cm), so that the electromagnetic wave focuser and the electrodeless bulb become larger in size. Further, the authorization to use this band is limited to the region of the Americas. Furthermore, in a 5800±75 MHz band, the resonant wavelength becomes short (the resonant wavelength at 5800 MHz is 5 cm), so that the electromagnetic wave focuser and the electrodeless bulb can be downsized but, on the other hand, has disadvantages that the light emission amount of the electrodeless bulb decreases and the like. With the 2450±50 MHz band, it is possible to balance the downsizing of the electromagnetic wave focuser 6 and the electrodeless bulb 7 with the light emission amount of the electrodeless bulb 7.

The anode part 12 is arranged to surround the cathode part 11. The power source unit 3 includes a main power supply 13, a power supply and control circuit 14, a cathode power supply 15, an anode power supply 16 and so on. From the power source unit 3, power is supplied to the cathode part 11 and the anode part 12. In a tube axis direction of the anode part 12, a magnetic field is applied from an excitation circuit 17. A concrete configuration of the electromagnetic wave generator 2 will be described later in detail.

By applying a positive voltage to the anode part 12 while heating the cathode part 11 by a heater, electrons are ejected from the cathode part 11 toward the anode part 12. The electrons ejected from the cathode part 11 orbit because their track is bent in a space between the cathode part 11 and the anode part 12 due to an electric field between the cathode part 11 and the anode part 12 and the magnetic field applied in the tube axis direction of the anode part 12. The orbiting electrons become thermionic currents and bunch up by a high frequency electric field of a resonator to synchronously rotate while forming a spoke-shaped electron pole. This generates a microwave. The generated microwave is emitted from an output part 18 of the electromagnetic wave generator 2.

The output part 18 of the electromagnetic wave generator 2 is arranged inside the waveguide 4. The microwave is emitted from the output part 18 of the electromagnetic wave generator 2 into the waveguide 4. The microwave emitted from the output part 18 is transmitted through the waveguide 4. Inside the waveguide 4, an input end 5*a* of the antenna 5 which receives the transmitted microwave is arranged. The antenna 5 is installed such that the input end 5*a* is arranged inside the waveguide 4 and an output end 5*b* is connected to the electromagnetic wave focuser 6. The microwave received by the input end 5*a* of the antenna 5 is radiated from the output end 5*b* to the electromagnetic wave focuser 6. Inside the electromagnetic wave focuser 6, the electrodeless bulb 7 is installed which is filled with the light-emitting material.

The electrodeless bulb 7 is composed of, for example, a quartz glass tube, a translucent ceramic tube or the like having a hollow structure. In the case of applying the ceramic tube to the electrodeless bulb 7, as its construction material, a sintered body or a single crystal body of alumina, aluminum nitride, yttrium aluminum composite oxide (YAG), magnesium aluminum composite oxide (spinel), yttria or the like can be exemplified. As the light-emitting material to be filled in the electrodeless bulb 7, a metal halide such as indium bromide ($InBr_3$ or the like), gallium iodide ($GaI_3$ or the like), strontium iodide ($SrI_2$ or the like) or the like, or sulfur (S), selenium (Se), or chemical compounds containing them or the like can be exemplified. The light-emitting material is enclosed in the electrodeless bulb 7 together with at least one of rare gas selected from argon (Ar), krypton (Kr), xenon (Xe) and so on.

As the electromagnetic wave focuser 6, a cavity resonator type and a dielectric resonator type are known. Among them, a dielectric resonator type electromagnetic wave focuser 6 is preferably used. Use of the dielectric resonator type electromagnetic wave focuser 6 improves the energy density of the microwave radiated to the electromagnetic wave focuser 6, thereby making it possible to improve the stability of plasma emission by the light emitting unit having the electrodeless bulb 7 to further increase the luminous output, luminous efficiency and so on. Further, the diffusion performance of heat generated during light emission of the electrodeless bulb 7 can be increased.

The dielectric resonator type electromagnetic wave focuser 6 includes a focuser main body 61 made of a high dielectric material. The focuser main body 61 of the dielectric resonator type electromagnetic wave focuser 6 is preferably made of a solid or liquid high dielectric material having a dielectric constant of 2 or more. Examples of the high dielectric material include ceramic materials (sintered bodies or single crystal bodies) containing, as a main constituent, alumina, zirconia, aluminum nitride, titanates such as barium titanate, strontium titanate and the like, zirconates such as strontium zirconate and the like, and their complex compounds.

In the case of using the dielectric resonator type electromagnetic wave focuser 6, the electrodeless bulb 7 in which the light-emitting material and the rare gas are enclosed is installed in the focuser main body 61 made of the high dielectric material. For example, a focuser main body 61 in a rectangular parallelepiped shape having a predetermined size is formed of a high dielectric material in a solid state. One surface of the focuser main body 61 is provided with a hollow portion 62, and the electrodeless bulb 7 is installed in the hollow portion 62. The output end 5*b* of the antenna 5 is installed at another surface of the focuser main body 61 facing, for example, the surface provided with the hollow portion 62. The installation positions of the electrodeless bulb 7 and the output end 5*b* of the antenna 5 are set according to the resonant frequency or the like of the microwave. The outer surface of the focuser main body 61 except the installation portions for the electrodeless bulb 7 and the hollow portion 62 may be covered with a metal coating or the like reflecting the microwave. This improves the energy density of the microwave.

The microwave radiated from the output end 5*b* of the antenna 5 to the electromagnetic wave focuser 6 resonates inside the focuser main body 61 made of, for example, the high dielectric material and is focused to the electrodeless bulb 7 installed based on the resonant frequency of the microwave or the like. The energy of the microwave focused to the electrodeless bulb 7 ionizes the rare gas filled in the electrodeless bulb 7 to generate plasma. The light-emitting material such as the metal halide or the like is excited by the generated plasma and emits light (plasma emission). The plasma emission is a phenomenon occurring in the bulb having no electrode (electrodeless bulb 7) and therefore has no deterioration due to physical contact and can provide a long-lifetime emitting device.

Incidentally, in the conventional plasma illumination device, sufficient luminous efficiency and total luminous flux are not obtained as described above. Many researchers repeated experiments and studies about its cause for a long time, but could not determine the cause. Under such circumstances, the present inventor has found, as a result of an earnest study, that a microwave generator being a supply source of the microwave has no sufficient output efficiency in the conventional plasma illumination device and therefore the luminous efficiency of a plasma emission device with respect to an input power is insufficient. For example, the total luminous flux of a 400 W-class high-intensity discharge lamp (HID) having a luminous efficiency of 100 lumens per 1 W of input power is on the order of 40000 lumens. To obtain, in the conventional plasma illumination device, the total luminous flux at the same level as that of the HID, a microwave generator having an output efficiency of 100% with respect to an input power of 400 W, and a light emitting unit having an electrodeless bulb capable of converting the microwave into light of 100 lumens per 1 W, are required. However, the output efficiency of the conventional microwave generator with respect to the input power of 400 W is on the order of 65%, so that the total luminous flux becomes 26000 lumens or less, and the luminous efficiency of the plasma illumination device is merely 65 lumens or less per 1 W of input power. Accordingly, it is found that the performance of the light emitting unit is not sufficiently drawn out. Besides, to obtain the total luminous flux of 40000 lumens by the illumination device, the input power to the microwave generator needs to be increased to generate an output of 400 W. In the case where the output efficiency of the microwave generator is 65%, the input power to the microwave generator needs to be 600 W or more.

Besides, the total luminous flux of a 700 W-class HID having a luminous efficiency of 100 lumens per 1 W of input power is about 70000 lumens (a lamp total luminous flux in an illumination device is on the order of 56000 lumens). To obtain, in the conventional plasma illumination device, the total luminous flux at the same level as that of the HID, a microwave generator having an output efficiency of roughly 80% to the 700 W-class plasma illumination device having a light emitting unit of converting into light of 100 lumens per 1 W of microwave, is required. However, the output efficiency of the conventional microwave generator with respect to the input power of 700 W is less than 70%, so that the lamp total luminous flux of the plasma illumination device having the light emitting unit converting into light of 100 lumens per 1 W of microwave, is 49000 lumens or less. The luminous efficiency of the plasma illumination device is merely 70 lumens or less per 1 W of input power. Therefore it is found that the performance of the light emitting unit is not sufficiently drawn out Besides, to obtain the total luminous flux of 56000 lumens in the illumination device, the input power needs to be about 810 W when the output efficiency of the microwave generator is less than 70%.

As described above, to obtain, in the conventional plasma illumination device, the total luminous flux at the same level as that of the HID, the input power needs to be increased, resulting in failure to realize energy saving. This is attributed to the output efficiency of the conventional microwave generator as described above. Namely, it has been found that the conventional microwave generator generates a high output with an input power of more than 700 W to 1000 W or less or more, but is insufficient in output with respect to an input power of 700 W or less, which is a cause to decrease the total luminous flux and the luminous efficiency of the conventional plasma illumination device. It has been also found that the output fluctuation of the microwave generator when the input power is changed in a range of 150 to 700 W is large, which decreases the luminous efficiency when the plasma illumination device is subjected to light control.

The present invention enables improvement in luminous efficiency and total luminous flux of the plasma illumination device by finding out the essentials of improvement in output efficiency with respect to an input power of 700 W or less of a microwave generator. More specifically, the plasma emission device 1 of the present invention includes an electromagnetic wave generator 2 whose maximum output efficiency of a microwave (electromagnetic wave) with respect to an input power of 700 W or less is 70% or more. The electromagnetic wave generator 2 having the maximum output efficiency of the microwave of 70% or more with respect to the input power of 700 W or less can cause the light emitting unit having the electrodeless bulb 7 to efficiently emit light. This makes it possible to enhance the total luminous flux and the luminous efficiency of the plasma emission device 1. To improve the maximum output efficiency of the microwave with respect to the input power of 700 W or less, it is effective to enhance the maximum output efficiency of the microwave to be generated in a low current region. The maximum output efficiency of the microwave in an anode current region of 200 mA or less of the electromagnetic wave generator 2 is preferably 70% or more. This makes it possible to provide the plasma emission device 1 excellent in brightness, energy saving property and so on with the input power of 700 W or less.

As has been described above, in the electromagnetic wave generator 2 in the first embodiment, the maximum output efficiency of the microwave to be generated with the input power of 700 W or less is 70% or more, and the maximum output efficiency of the microwave to be generated in the anode current region of 200 mA or less is 70% or more. Though the lower limit value of the input power is not particularly limited, the microwave preferably exhibits the maximum output efficiency in a range of 150 W or more and 700 W or less. The microwave preferably exhibits the maximum output efficiency in a range of 50 mA or more and 200 mA or less. Further, the 400 W-class plasma emission device 1 is constituted, the microwave to be generated in the electromagnetic wave generator 2 preferably exhibits the maximum output efficiency in a range of 150 W or more and 500 W or less.

Use of the electromagnetic wave generator 2 having 70% or more of the maximum output efficiency of the microwave to be generated with the input power of 700 W or less makes it possible to enhance the luminous efficiency and the total luminous flux of the plasma emission device 1 excellent in energy saving property. Further, generation of the microwave in the anode current region of 200 mA or less with respect to the input power of 700 W or less makes it possible to enhance the maximum output efficiency of the microwave with respect to the input power of 700 W or less. Accordingly, it is possible to provide, with high repeatability, the plasma emission device 1 excellent in energy saving property, luminous efficiency, total luminous flux and so on with the input power of 700 W or less. The maximum output efficiency of the microwave is more preferable 75% or more in the above-described input power region and anode current region, thereby making it possible to further improve the luminous efficiency and the total luminous flux.

The output efficiency [unit: %] of the microwave (electromagnetic wave) in the electromagnetic wave generator 2 is a value obtained based on the following Expression (1) from an operating voltage (anode voltage) Eb [unit: kV], an anode current Ib [unit: mA], and an output power Po [unit: W].

$$\text{Output efficiency [\%]} = \text{output}/(\text{operating voltage} \times \text{anode current}) \times 100 \quad (1)$$

The input power to the electromagnetic wave generator 2 is a value obtained based on the following Expression (2).

$$\text{Input power [W]} = \text{operating voltage [kV]} \times \text{anode current [mA]} \quad (2)$$

The maximum output efficiency of the microwave indicates the maximum value of the output efficiency in the input power of 700 W or less, or the maximum value of the output efficiency in the anode current of 200 mA or less.

Table 1 and FIGS. 3 to 7 illustrate examples of the input power, the anode current, the operating voltage (anode voltage), the output power, the output efficiency of the microwave, and the oscillation frequency of an electromagnetic wave generator 2 according to Example 1. The electromagnetic wave generator 2 in Example 1 is found to have 70% or more (concretely, 76.3%) of a maximum output efficiency with respect to the input power of 700 W or less and a maximum output efficiency in the anode current region (low current region) of 200 mA or less (see Table 1, and FIGS. 3 to 4). The electromagnetic wave generator 2 in Example 1 is also found to have small fluctuation in output efficiency with respect to an input power in a range of 150 to 700 W and an anode current in a range of 50 to 200 mA (see Table 1, and FIGS. 3 to 4). The electromagnetic wave generator 2 in Example 1 is found to keep an operating voltage of the order of 3.5 to 3.7 kV with respect to the input power of 700 W or less (see Table 1, FIG. 5).

TABLE 1

| INPUT Pin[W] | ANODE CURRENT Ib[mA] | OPERATING VOLTAGE Eb[kV] | OUTPUT Po[W] | OUTPUT EFFICIENCY [%] | FREQUENCY [MHz] |
|---|---|---|---|---|---|
| EXAMPLE 1 | | | | | |
| 105 | 30 | 3.50 | 71 | 67.5 | 2453 |
| 140 | 40 | 3.50 | 97 | 69.3 | 2453 |
| 158 | 45 | 3.50 | 111 | 70.5 | 2453 |
| 193 | 55 | 3.50 | 139 | 72.2 | 2454 |
| 246 | 70 | 3.52 | 182 | 73.9 | 2458 |
| 300 | 85 | 3.53 | 225 | 75.0 | 2461 |
| 355 | 100 | 3.55 | 270 | 76.1 | 2463 |
| 412 | 115 | 3.58 | 314 | 76.3 | 2465 |
| 430 | 120 | 3.59 | 327 | 75.9 | 2466 |
| 537 | 150 | 3.65 | 410 | 74.9 | 2467 |
| 700 | 190 | 3.69 | 518 | 74.0 | 2468 |
| 716 | 200 | 3.70 | 540 | 73.0 | 2469 |
| COMPARATIVE EXAPLE 1 | | | | | |
| 166 | 45 | 3.68 | 91 | 55.0 | 2437 |
| 203 | 55 | 3.69 | 120 | 59.1 | 2439 |
| 259 | 70 | 3.70 | 162 | 62.5 | 2442 |
| 317 | 85 | 3.73 | 206 | 65.0 | 2447 |
| 375 | 100 | 3.75 | 248 | 66.1 | 2452 |
| 415 | 110 | 3.77 | 277 | 66.8 | 2454 |
| 572 | 150 | 3.81 | 392 | 68.6 | 2458 |
| 774 | 200 | 3.87 | 538 | 69.5 | 2461 |

Table 1 and FIGS. 3 to 7 additionally illustrate an electromagnetic wave generator having a maximum output efficiency with respect to the input power of 700 W or less and the anode current region of 200 mA or less of less than 70% as Comparative Example 1. In the electromagnetic wave generator in Comparative Example 1, not only the maximum output efficiency in the low current region is less than 70% (concretely, 69.5%) but also the output efficiency greatly fluctuates with respect to the input power in the range of 150 to 700 W and the anode current in the range of 50 to 200 mA and decreases to 60% or less depending on the input power and the anode current. Accordingly, the electromagnetic wave generator 2 in Example 1 is excellent in output characteristics as compared to the electromagnetic wave generator in Comparative Example 1 (see Table 1, FIG. 6).

Figure 8:
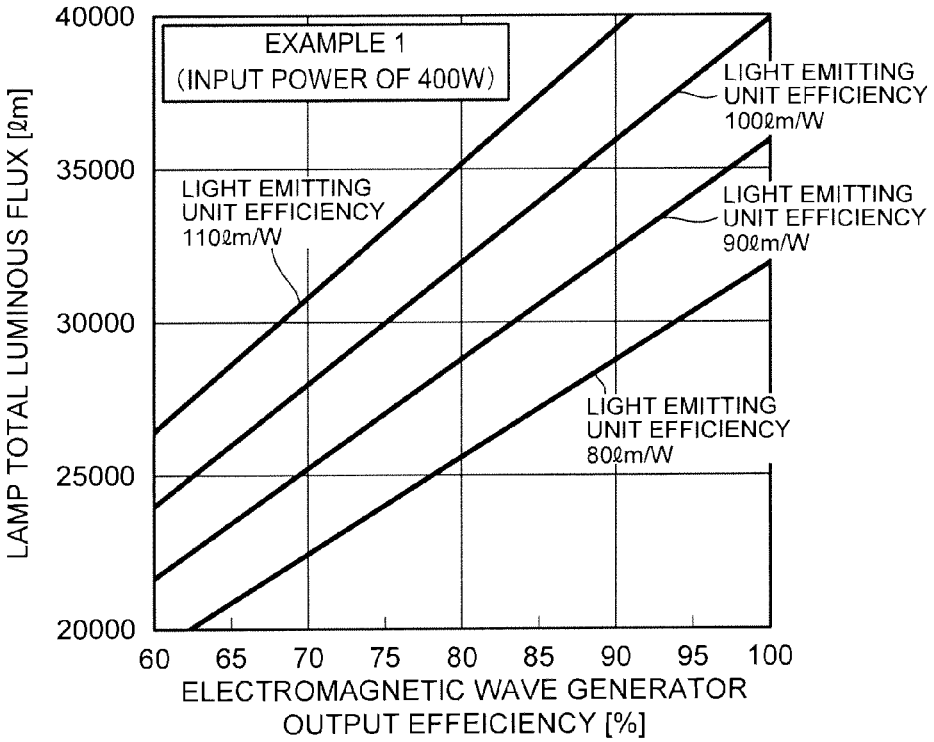
FIG. 8 is a chart illustrating the relation between the output efficiency and the lamp total luminous flux of the electromagnetic wave generator in a first plasma emission device (an input of 400 W) in the first embodiment.
Figure 9:
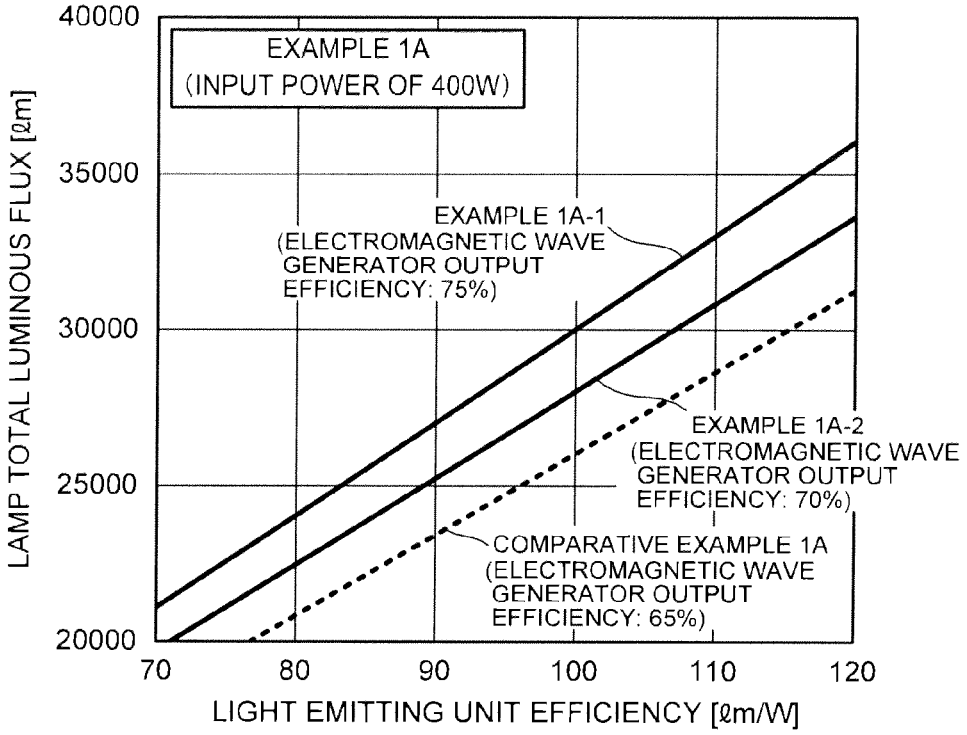
FIG. 9 is a chart illustrating the relation between the light emitting unit efficiency and the lamp total luminous flux in the first plasma emission device (an input of 400 W) in the first embodiment.

Next, the relation between the output efficiency of the electromagnetic wave generator 2 and the characteristics of the plasma emission device 1 using it will be described. First, the characteristics of a plasma emission device with 400 W-class input power (Example 1A) will be described based on Table 2 and FIGS. 8 to 12. FIG. 8 illustrates the relation between the output efficiency of the electromagnetic wave generator in Example 1 and the total luminous flux of the 400 W-class plasma emission device (Example 1A) using it. FIG. 8 illustrates the relation between the output efficiency of the electromagnetic wave generator and the total luminous flux of the plasma emission device on the basis of the light emitting unit efficiency (lamp luminous efficiency). FIG. 9 illustrates the relation between the light emitting unit efficiency of the plasma emission device and the total luminous flux, about a plasma emission device (Example 1A-1) using an electromagnetic wave generator 2 having an output efficiency of 75%, a plasma emission device (Example 1A-2) using an electromagnetic wave generator having an output efficiency of 70%, and a plasma emission device (Comparative Example 1A) using an electromagnetic wave generator having an output efficiency of 65%. As is clear from FIG. 8 and FIG. 9, use of the electromagnetic wave generator 2 having a maximum output efficiency in a low power region and a low current region of 70% or more makes it possible to improve the total luminous flux of the 400 W-class plasma emission device 1.

Figure 3:
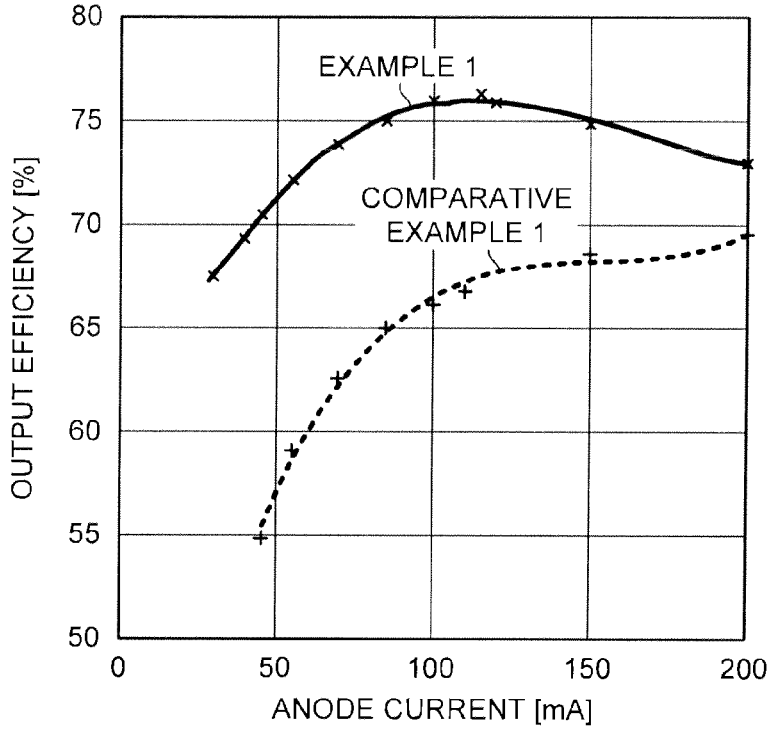
FIG. 3 is a chart illustrating the relation between the anode current and the output efficiency of the electromagnetic wave generator in the plasma emission device in the first embodiment.
Figure 4:
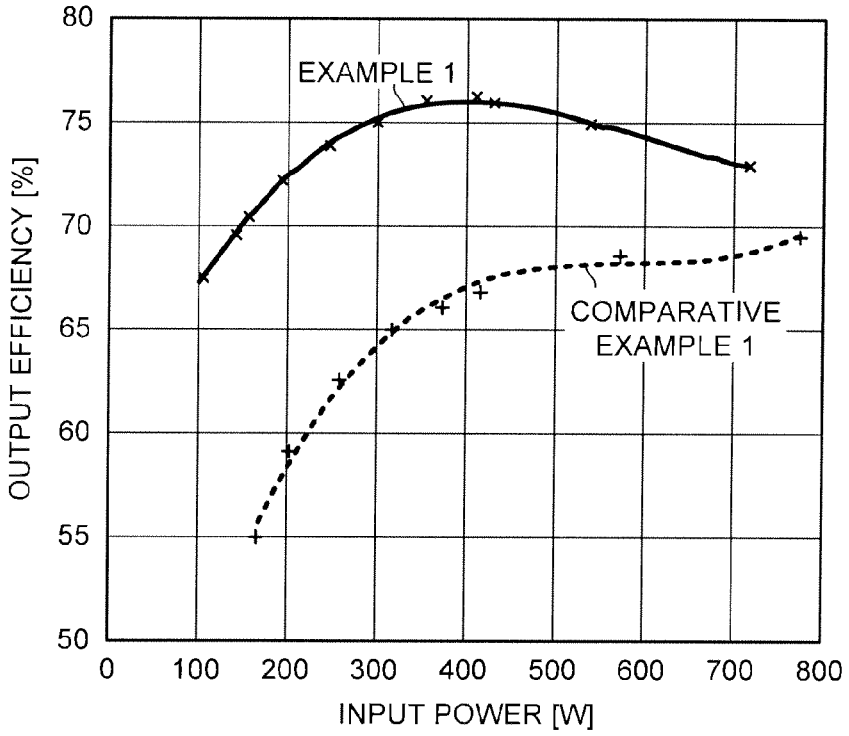
FIG. 4 is a chart illustrating the relation between the input power and the output efficiency of the electromagnetic wave generator in the plasma emission device in the first embodiment.
Figure 5:
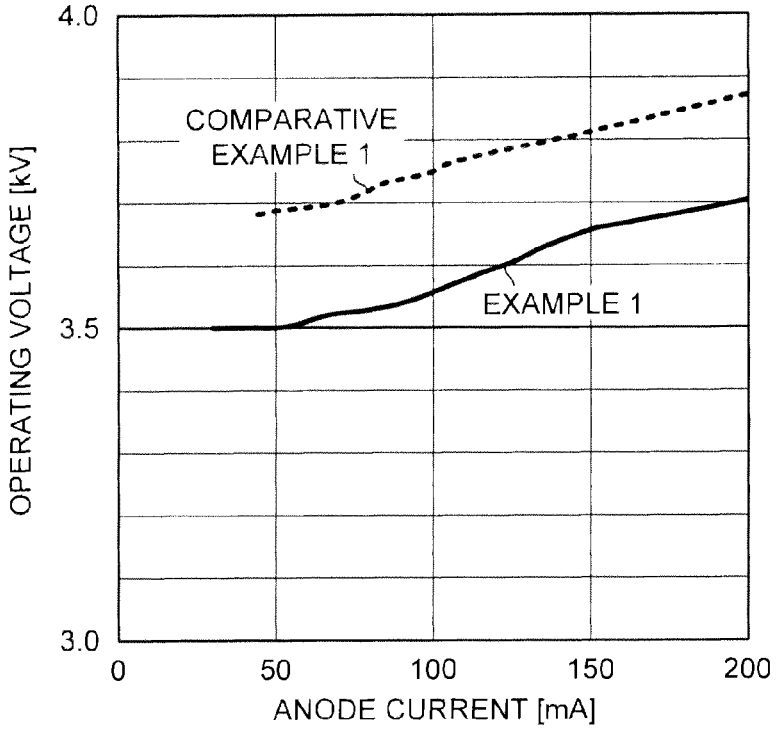
FIG. 5 is a chart illustrating the relation between the anode current and the operating voltage of the electromagnetic wave generator in the plasma emission device in the first embodiment.
Figure 6:
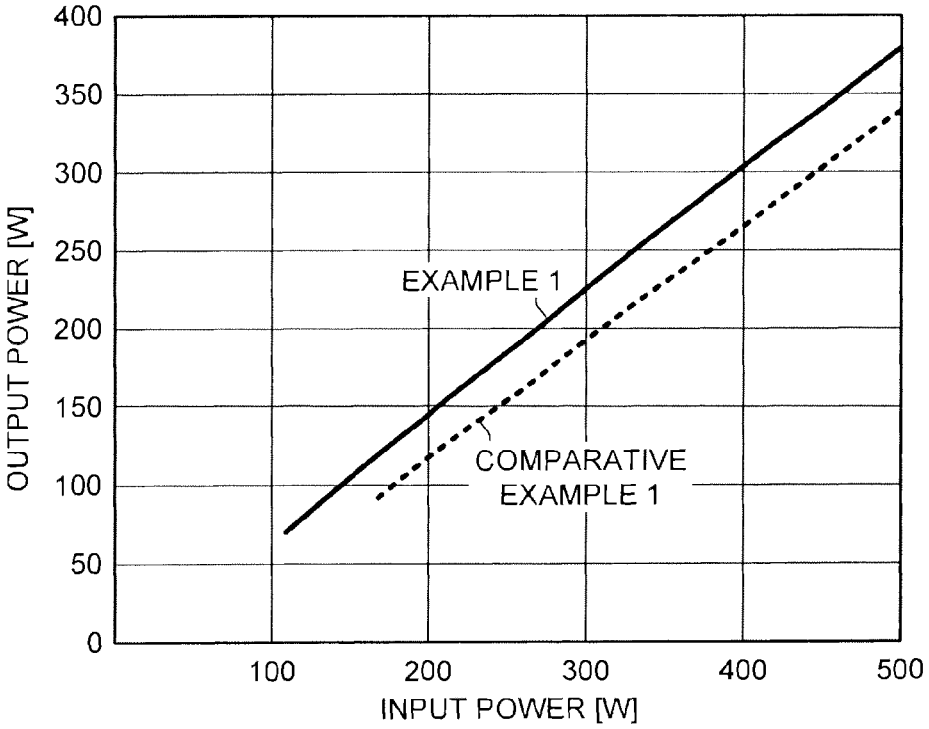
FIG. 6 is a chart illustrating the relation between the input power and the output power of the electromagnetic wave generator in the plasma emission device in the first embodiment.
Figure 7:
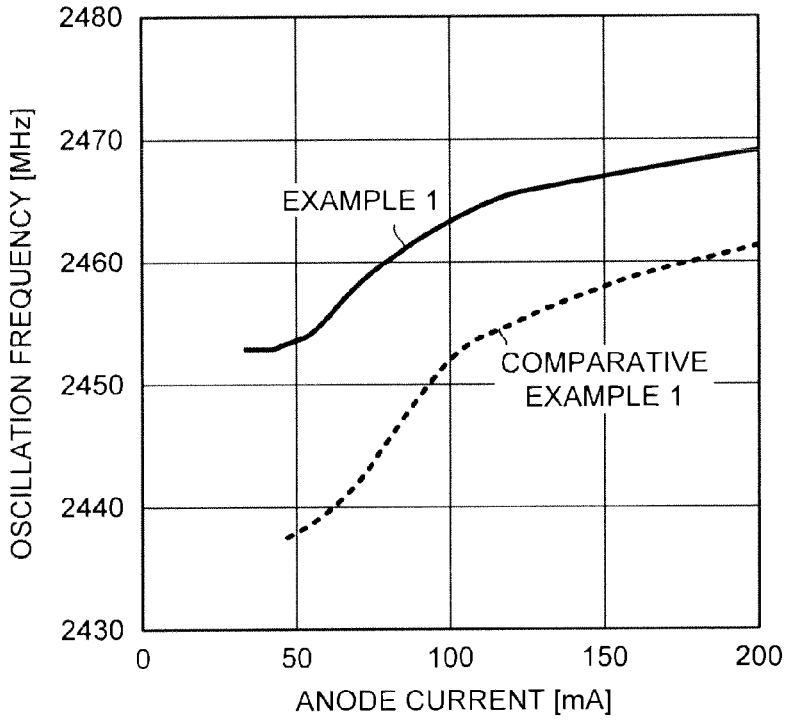
FIG. 7 is a chart illustrating the relation between the anode current and the oscillation frequency of the electromagnetic wave generator in the plasma emission device in the first embodiment.

The electromagnetic wave generator 2 in Example 1 is not only excellent in a maximum output efficiency in the low power region and the low current region but also small in fluctuation range of the output efficiency with respect to the input power in the range of 150 to 700 W and the anode current in the range of 50 to 200 mA (see Table 1, FIGS. 3 to 4). Concretely, the electromagnetic wave generator 2 in Example 1 has a fluctuation rate of the output efficiency with respect to the input power in the range of 150 to 700 W and the anode current in the range of 50 to 200 mA of 15% or less (concretely, 7.6%). Here, the fluctuation rate of the output efficiency of the electromagnetic wave generator 2 is a value obtained based on the following Expression (3) from the maximum value and the minimum value of the output efficiency with respect to the input power in the range of 150 to 700 W and the anode current in the range of 50 to 200 mA.

$$\text{Fluctuation rate of output efficiency [\%]} = (\text{maximum value} - \text{minimum value})/\text{maximum value} \times 100 \quad (3)$$

Figure 10:
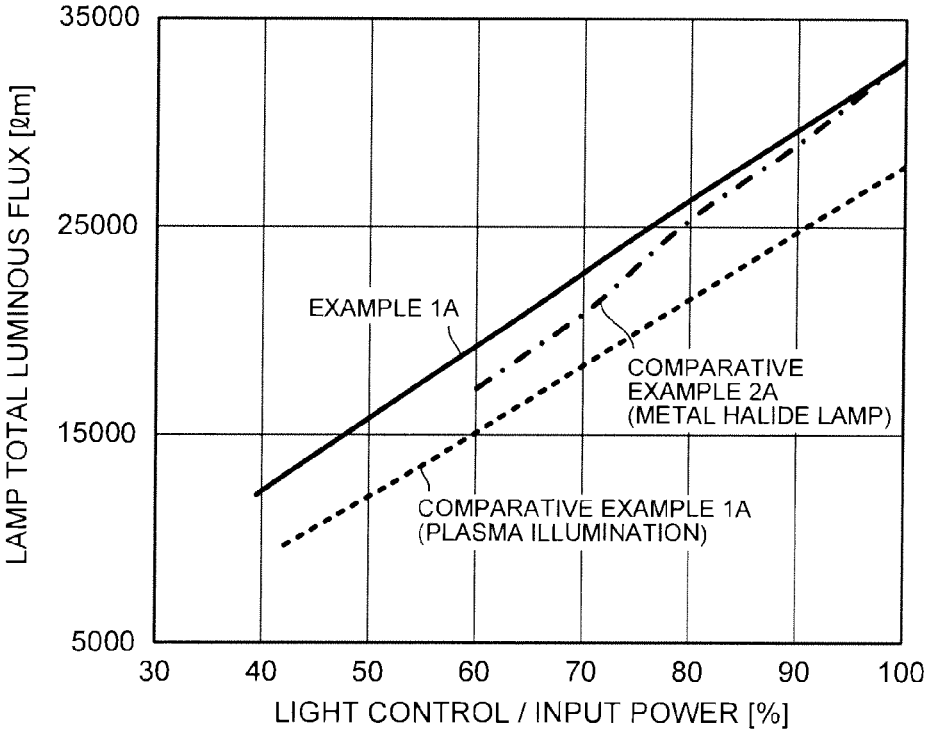
FIG. 10 is a chart illustrating the relation between the input power and the lamp total luminous flux at light control time of the first plasma emission device (an input of 400 W) in the first embodiment.
Figure 11:
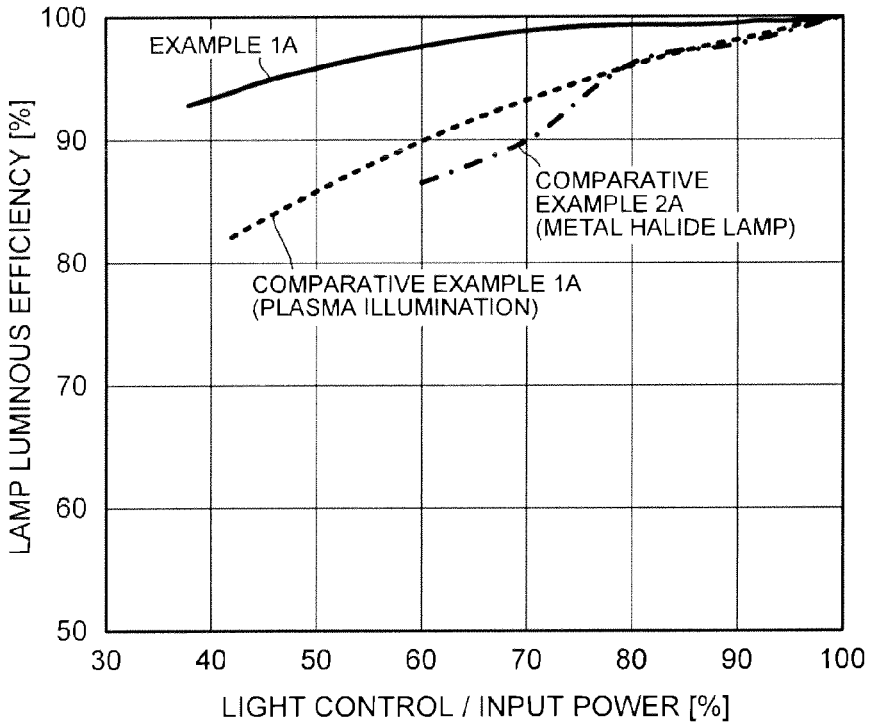
FIG. 11 is a chart illustrating the relation between the input power and the lamp luminous efficiency at light control time of the first plasma emission device (an input of 400 W) in the first embodiment.
Figure 12:
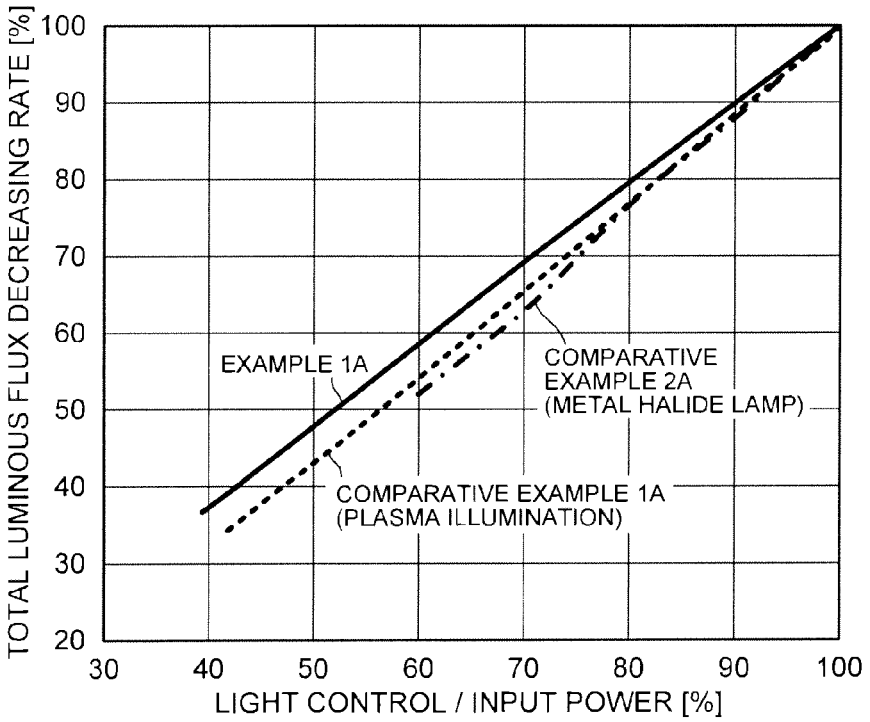
FIG. 12 is a chart illustrating the relation between the input power and the decreasing rate of the lamp total luminous flux at light control time of the first plasma emission device (an input of 400 W) in the first embodiment.

Table 2 and FIGS. 10 to 12 illustrate measured results of a lamp total luminous flux (FIG. 10), a lamp luminous efficiency (FIG. 11), and a decreasing rate of total luminous flux (FIG. 12) when the input power is changed in a range of 150 to 400 W. These drawings correspond to the lamp total luminous flux, the lamp luminous efficiency and so on when the input power to the plasma emission device 1 is changed to perform light control. FIG. 10 to FIG. 12 additionally illustrate measured results of the total luminous flux, the luminous efficiency, the decreasing rate of total luminous flux at light control time of a plasma emission device (Comparative Example 1A) using the electromagnetic wave generator in Comparative Example 1 and a 400 W-class metal halide lamp (Comparative Example 2A). The light control of the metal halide lamp (Comparative Example 2A) was carried out using a light control stabilizer.

TABLE 2

| INPUT Pin | | LAMP TOTAL LUMINOUS FLUX | | LAMP LUMINOUS EFFICIENCY | |
|---|---|---|---|---|---|
| [W] | [%] | [klm] | [%] | [lm/W] | [%] |
| EXAMPLE 1A (400 W) | | | | | |
| 400 | 100 | 33.0 | 100 | 82.5 | 100 |
| 355 | 89 | 29.3 | 88.7 | 82.5 | 99.4 |
| 300 | 75 | 24.6 | 74.5 | 81.9 | 99.3 |
| 246 | 62 | 19.9 | 60.2 | 80.7 | 97.8 |
| 193 | 48 | 15.1 | 45.9 | 78.6 | 95.3 |
| 158 | 39 | 12.1 | 36.7 | 76.8 | 93.1 |
| COMPARATIVE EXAMPLE 1A (400 W) | | | | | |
| 400 | 100 | 28.0 | 100 | 70.0 | 100 |
| 375 | 94 | 26.0 | 92.7 | 69.2 | 98.9 |
| 317 | 79 | 21.3 | 76.0 | 67.1 | 95.9 |
| 259 | 65 | 16.6 | 59.4 | 64.2 | 91.7 |
| 203 | 51 | 12.3 | 43.8 | 60.4 | 86.3 |
| 166 | 41 | 9.5 | 33.9 | 57.3 | 81.8 |

TABLE 2-continued

| INPUT Pin | | LAMP TOTAL LUMINOUS FLUX | | LAMP LUMINOUS EFFICIENCY | |
|---|---|---|---|---|---|
| [W] | [%] | [klm] | [%] | [lm/W] | [%] |
| COMPARATIVE EXAMPLE 2A (METAL HALIDE LAMP) | | | | | |
| 400 | 100 | 33.0 | 100 | 82.5 | 100 |
| 360 | 90 | 29.0 | 88.0 | 80.7 | 97.8 |
| 320 | 80 | 25.4 | 77.0 | 79.4 | 96.3 |
| 280 | 70 | 20.8 | 63.0 | 74.3 | 90.0 |
| 240 | 60 | 17.2 | 52.0 | 71.5 | 86.7 |

As illustrated in Table 2 and FIGS. 10 to 12, in the electromagnetic wave generator 2 having 15% or less of a fluctuation rate of the output efficiency with respect to the input power in the range of 150 to 700 W, the luminous efficiency of the light emitting unit is kept, for example, even in the case where the input power is changed to adjust the brightness (light control) of the plasma emission device 1. In other words, the plasma emission device (Example 1A) using the electromagnetic wave generator in Example 1 is excellent not only in total luminous flux but also in luminous efficiency at light control time. Accordingly, it is possible to suppress an increase in power consumption and so on with a decrease in luminous efficiency at light control time. Further, since the fluctuation range of the output efficiency with respect to an input power of 400 W to 150 W is small, a light control range can be widened to about 30% of that at full-lighting time (100%). In the case of the metal halide lamp, even if using the light controller, the light control range is only on the order of 60% of that at full-lighting time (100%).

Figure 13:
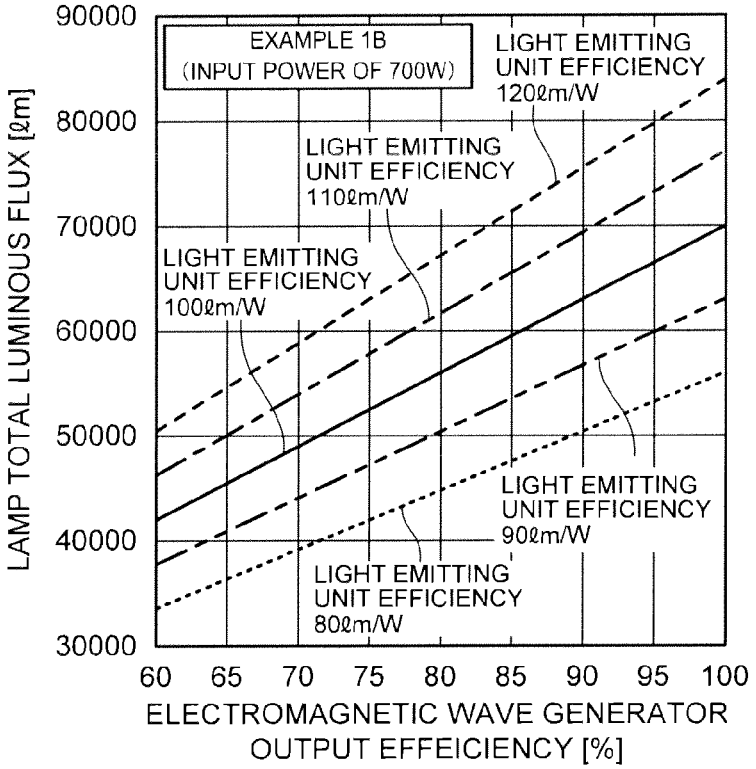
FIG. 13 is a chart illustrating the relation between the output efficiency and the lamp total luminous flux of the electromagnetic wave generator in a second plasma emission device (an input of 700 W) in the first embodiment.
Figure 14:
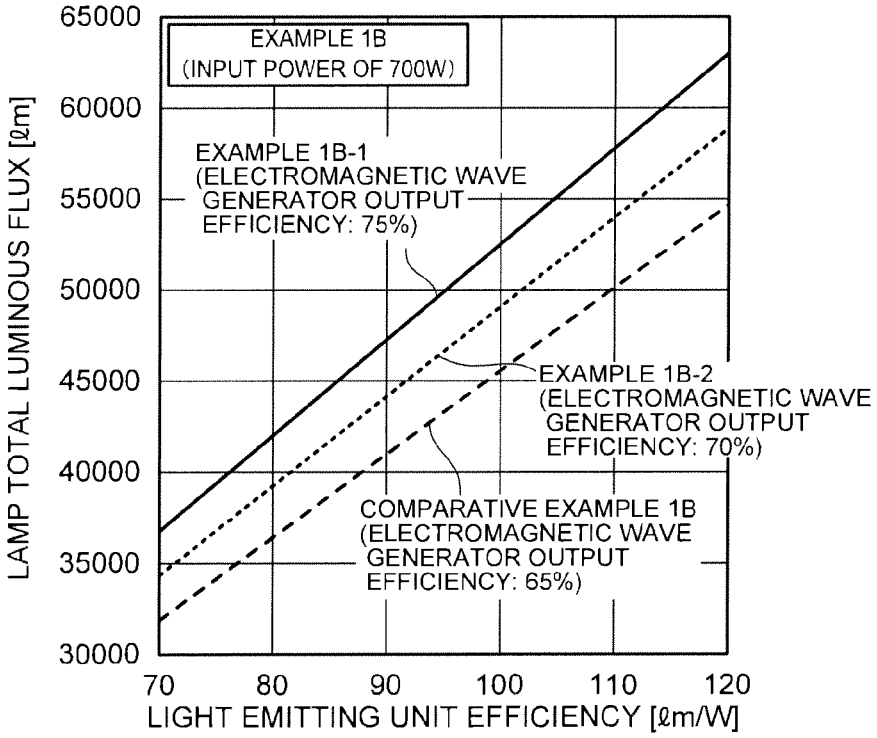
FIG. 14 is a chart illustrating the relation between the light emitting unit efficiency and the lamp total luminous flux in the second plasma emission device (an input of 700 W) in the first embodiment.

Next, the characteristics of a plasma emission device (Example 1 B) with 700 W-class input power will be described based on Table 3 and FIGS. 13 to 17. FIG. 13 illustrates the relation between the output efficiency of the electromagnetic wave generator in Example 1 and the lamp total luminous flux of the 700 W-class plasma emission device (Example 1 B) using it. FIG. 13 illustrates the relation between the output efficiency of the electromagnetic wave generator and the lamp total luminous flux of the plasma emission device on the basis of the light emitting unit efficiency (lamp luminous efficiency). FIG. 14 illustrates the relation between the light emitting unit efficiency of the plasma emission device and the lamp total luminous flux, about a plasma emission device (Example 1B-1) using an electromagnetic wave generator 1 having an output efficiency of 75%, a plasma emission device (Example 1B-2) using an electromagnetic wave generator having an output efficiency of 70%, and a plasma emission device (Comparative Example 1B). using an electromagnetic wave generator having an output efficiency of 65% As is clear from FIG. 13 and FIG. 14, use of the electromagnetic wave generator 2 having a maximum output efficiency in a low power region and a low current region of 70% or more makes it possible to enhance the total luminous flux of the 700 W-class plasma emission device 1.

Figure 15:
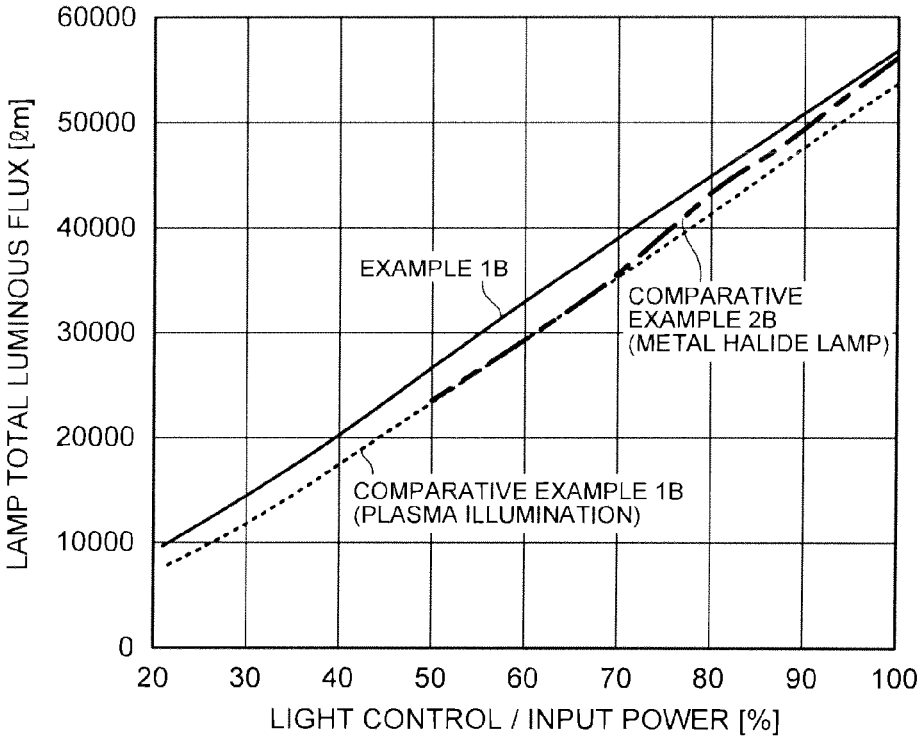
FIG. 15 is a chart illustrating the relation between the input power and the lamp total luminous flux at light control time of the second plasma emission device (an input of 700 W) in the first embodiment.
Figure 16:
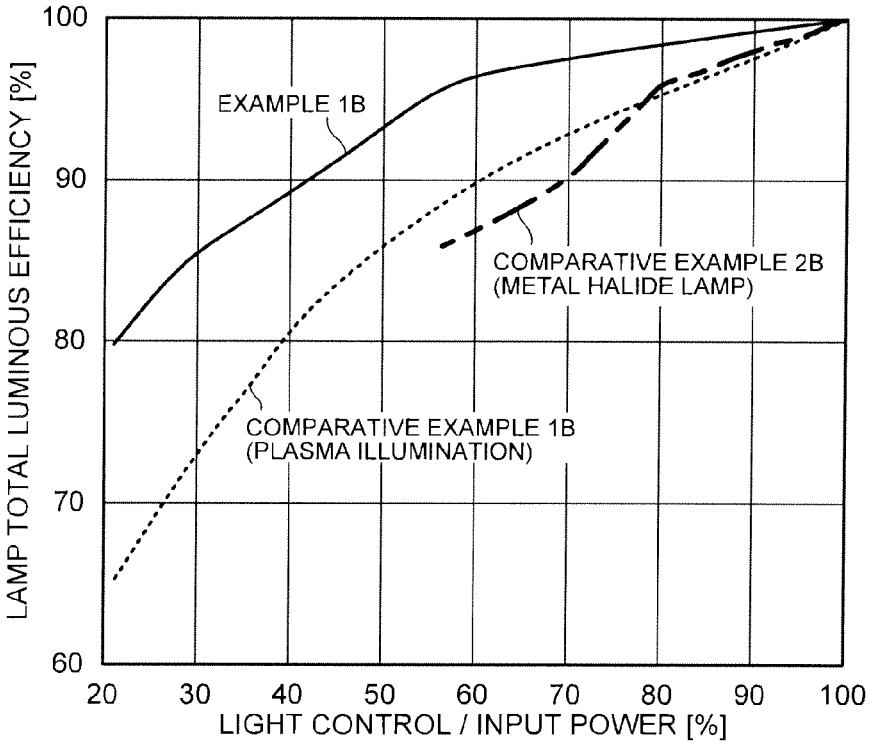
FIG. 16 is a chart illustrating the relation between the input power and the lamp luminous efficiency at light control time of the second plasma emission device (an input of 700 W) in the first embodiment.
Figure 17:
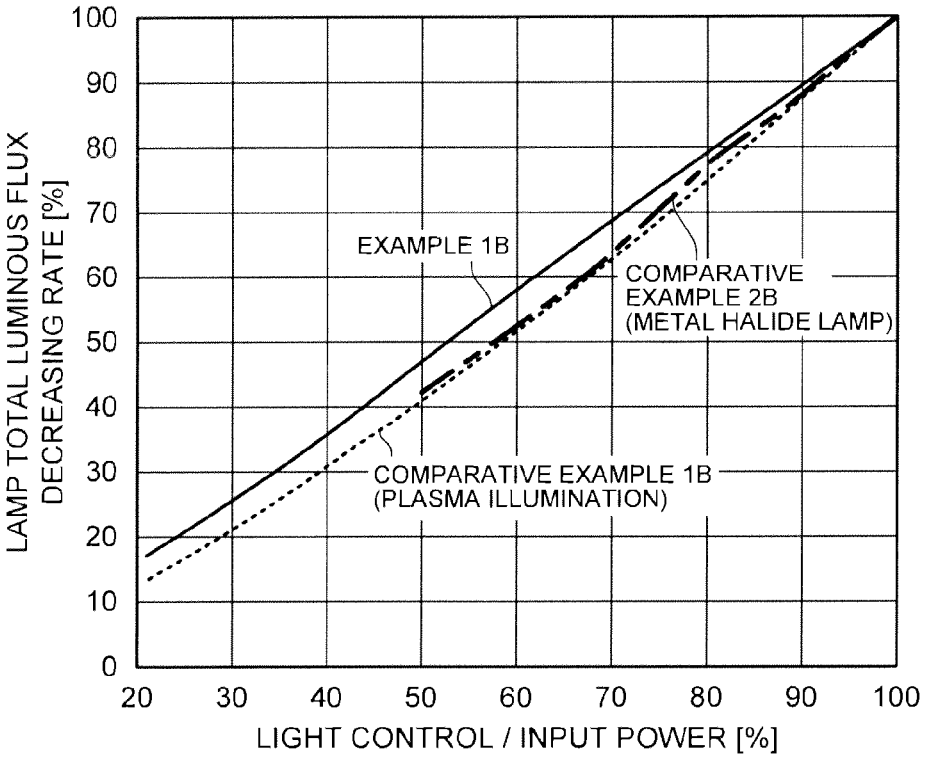
FIG. 17 is a chart illustrating the relation between the input power and the decreasing rate of a lamp total luminous flux at light control time of the second plasma emission device (an input of 700 W) in the first embodiment.

The electromagnetic wave generator 2 in Example is not only excellent in maximum output efficiency in the low power region and the low current region as described above, but also small in fluctuation range of the output efficiency with respect to the input power in the range of 150 to 700 W and the anode current in the range of 50 to 200 mA, concretely 15% or less (concretely, 7.6%). Table 3 and FIGS. 15 to 17 illustrate measured results of a lamp total luminous flux (FIG. 15), a lamp luminous efficiency (FIG. 16), and a decreasing rate of total luminous flux (FIG. 17) when the input power is changed in the range of 150 to 700 W. These drawings correspond to the total luminous flux, the luminous efficiency and so on when the input power to the plasma emission device 1 is changed to perform light control. FIGS. 15 to 17 additionally illustrate measured results of the total luminous flux, the luminous efficiency, the decreasing rate of total luminous flux at light control time of the plasma emission device (Comparative Example 1B) using electromagnetic wave generator in Comparative Example 1 and the 700 W-class metal halide lamp (Comparative Example 2B). The light control of the metal halide lamp was carried out using a light control stabilizer.

TABLE 3

| INPUT Pin | | LAMP TOTAL LUMINOUS FLUX | | LAMP LUMINOUS EFFICIENCY | |
|---|---|---|---|---|---|
| [W] | [%] | [klm] | [%] | [lm/W] | [%] |
| EXAMPLE 1B (700 W) | | | | | |
| 700 | 100 | 56.7 | 100 | 81 | 100 |
| 500 | 71 | 39.5 | 70 | 79 | 98 |
| 400 | 57 | 31.0 | 55 | 78 | 96 |
| 300 | 43 | 22.0 | 39 | 73 | 90 |
| 200 | 29 | 13.8 | 24 | 69 | 85 |
| 150 | 21 | 9.7 | 17 | 65 | 80 |
| COMPARATIVE EXAMPLE 1B (700 W) | | | | | |
| 700 | 100 | 53.6 | 100 | 77 | 100 |
| 500 | 71 | 35.9 | 63 | 72 | 93 |
| 400 | 57 | 27.4 | 48 | 68 | 89 |
| 300 | 43 | 19.0 | 34 | 63 | 82 |
| 200 | 29 | 11.1 | 20 | 56 | 72 |
| 150 | 21 | 7.5 | 13 | 50 | 65 |
| COMPARATIVE EXAMPLE 2B (METAL HALIDE LAMP) | | | | | |
| 700 | 100 | 56.0 | 100 | 80 | 100 |
| 63 | 90 | 49.3 | 88 | 78 | 98 |
| 560 | 80 | 43.1 | 77 | 77 | 96 |
| 490 | 70 | 35.3 | 63 | 72 | 90 |
| 420 | 60 | 29.1 | 52 | 69 | 87 |
| 350 | 50 | 23.5 | 42 | 67 | 84 |

As illustrated in Table 3 and FIGS. 15 to 17, in the electromagnetic wave generator 2 having a fluctuation rate of the output efficiency with respect to the input power in the range of 150 to 700 W of 15% or less, the luminous efficiency of the light emitting unit is kept, for example, even in the case where the input power is changed to adjust the brightness (light control) of the plasma emission device 1. In other words, the plasma emission device (Example 1B) using the electromagnetic wave generator in Example 1 is excellent not only in total luminous flux but also in luminous efficiency at light control time. Accordingly, it is possible to suppress an increase in power consumption and so on with a decrease in luminous efficiency at light control time. Further, since the fluctuation range of the output efficiency with respect to an input power of 700 W to 150 W is small, a light control range can be widened to about 30% of that at full-lighting time (100%). In the case of the 700 W-class metal halide lamp, even if using a light controller, the light control range is only on the order of 50% of that at full-lighting time.

As described above, employing the electromagnetic wave generator 2 having a maximum output efficiency with respect to the input power of 700 W or less of 70% or more makes it possible to improve the total luminous flux of, for example, the 400 W-class or 700 W-class plasma emission device 1. Further, this also applies to the plasma emission device 1 with an input power of less than 400 W. Further, generating an electromagnetic wave in the anode current region of 200 mA or less with respect to the input power of 700 W or less makes it possible to enhance the maximum output efficiency of the electromagnetic wave. Accordingly, it becomes possible to improve the total luminous flux of the plasma emission device 1 with the input power of 700 W or less. In addition, in the electromagnetic wave generator 2 having a fluctuation rate of the output efficiency with respect to the input power in the range of 150 to 700 W of 15% or less, light control of the plasma emission device 1 can be efficiently performed to further widen the light control range.

The plasma emission device 1 in the first embodiment is suitable for an illumination device required to have a high output for an illumination fixture installed at a high ceiling of a warehouse, road illumination or the like, similarly to an HID such as a high-pressure mercury lamp, a metal halide lamp, a high-pressure sodium lamp or the like. Further, the plasma emission device 1 can perform light control while keeping the mission efficiency with the input power in the range of 150 to 700 W and is therefore excellent in energy saving property as compared to the HID, and the plasma emission device 1 uses the light emitting unit having the electrodeless bulb 7 and is therefore excellent in lifetime characteristics. Accordingly, the plasma emission device 1 in the embodiment is very effectively usable as an energy-saving illumination device that embodies decreased power consumption by improving the energy efficiency and decreased device cost and maintenance cost by extending the lifetime. The plasma emission device 1 in the embodiment is effective for the illumination device with the input power of 700 W or less, and can also be used, for example, as an illumination device with an input power of the order of 800 W (an illumination device with an input power of the order of more than 700 W and 800 W or less). Furthermore, the plasma emission device 1 in the embodiment is not limited to the illumination device but is also applicable to a light source of a projector or the like.

Figure 18:
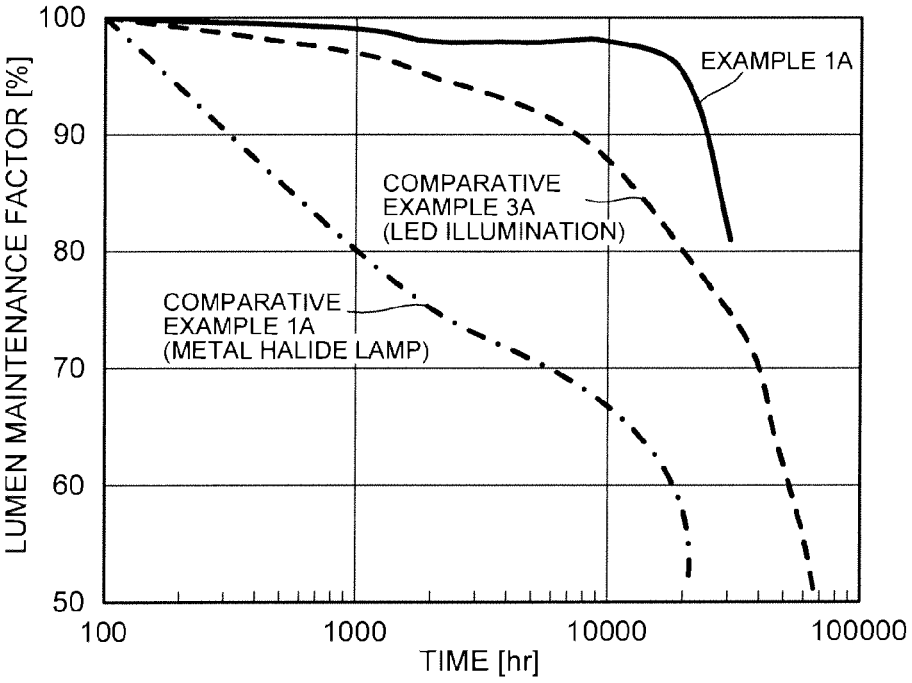
FIG. 18 is a chart illustrating a lumen maintenance factor of the plasma emission device in the first embodiment compared to that of a conventional illumination device.

Table 4 and FIG. 18 illustrate measured results of temporal lumen maintenance factors by accelerated tests of the plasma emission device in the first embodiment (Example 1A), the metal halide lamp (Comparative Example 1A), and an LED (Comparative Example 3A). As illustrated in Table 4 and FIG. 18, the plasma emission device in the embodiment (Example 1A) is excellent in lumen maintenance factor than the metal halide lamp (Comparative Example 1A). In comparison of the lumen maintenance factors of the plasma emission device, the metal halide lamp, and the LED, the plasma emission device in the embodiment (Example 1A) is found to be excellent in lumen maintenance factor after 10000 hours and to be superior also in lumen maintenance factor after 20000 hours, as compared with the metal halide lamp (Comparative Example 1A) and the LED (Comparative Example 3A).

TABLE 4

| EXAMPLE 1A (PLASMA EMISSION DEVICE) | | COMPARATIVE EXAMPLE 1A (METAL HALIDE LAMP) | | COMPARATIVE EXAMPLE 3A (LED) | |
|---|---|---|---|---|---|
| Time [hr] | Luminous flux maintenance factor [%] | Time [hr] | Luminous flux maintenance factor [%] | Time [hr] | Luminous flux maintenance factor [%] |
| 100 | 100 | 100 | 100 | 100 | 100 |
| 1000 | 99 | 1000 | 80 | 1000 | 97 |
| 2000 | 98 | 2000 | 75 | 2000 | 95 |
| 5000 | 98 | 5000 | 71 | 5000 | 92 |
| 10000 | 98 | 10000 | 67 | 10000 | 88 |
| 20000 | 95 | 15000 | 63 | 20000 | 80 |
| 30000 | 81 | 20000 | 58 | 30000 | 75 |
| — | — | 21000 | 52 | 40000 | 70 |
| — | — | — | — | 45000 | 65 |
| — | — | — | — | 60000 | 55 |
| — | — | — | — | 100000 | 30 |

Next, a concrete configuration of the electromagnetic wave generator 2 used in the plasma emission device 1 in the first embodiment will be described referring to FIGS. 19 to 21. The electromagnetic wave generator 2 includes the cathode part 11 (negative electrode part) and the anode part 12 (positive electrode part) as an oscillating unit main body. The anode part 12 has an anode cylinder 21 and a plurality of anode resonant plates 22 radially arranged at regular intervals from an inner wall of the anode cylinder 21 toward its tube axis. The anode resonant plate 22 has an outer end portion fixed to the inner wall of the anode cylinder 21 and an inner end portion being a free end. The cathode part 11 has a filament 23, for example, in a spiral shape, disposed on the inside of the anode cylinder 21 along the tube axis. The filament 23 is disposed in an electron interaction space that forms a cavity resonator, spaced from the free ends of the anode resonant plates 22.

To upper sides (on the output part side) and lower sides (on the input part side) of the anode resonant plates 22, a pair of first strap rings 24*a*, 24*b* and a pair of second strap rings 25*a*, 25*b* located outside the first strap rings 24*a*, 24*b* and larger in diameter than the first strap rings, are alternately connected. For example, as for the upper sides of the anode resonant plates 22, odd numbered anode resonant plates 22 counted from a first anode resonant plate 22 are connected together by the first strap ring 24*a*, and even numbered anode resonant plates 22 are connected together by the first strap ring 25*a*. As for the lower sides of the anode resonant plates 22, conversely, odd numbered anode resonant plates 22 are connected together by the second strap ring 25*b*, and even numbered anode resonant plates 22 are connected together by the first strap ring 24*b*.

At both end portions in the direction of the tube axis of the anode cylinder 21, a pair of magnetic flux collecting plates 26*a*, 26*b* are provided to face each other. Each of the magnetic flux collecting plates 26*a*, 26*b* has a funnel shape and provided with a through hole at its center. The centers of the through holes of the magnetic flux collecting plates 26*a*, 26*b* are located on the tube axis of the anode cylinder 21. Above the magnetic flux collecting plate 26*a* and below the magnetic flux collecting plate 26*b*, annular permanent magnets 27*a*, 27*b* are arranged. The permanent magnets 27*a*, 27*b* are surrounded by a yoke 28. The magnetic flux collecting plates 26*a*, 26*b*, the permanent magnets 27*a*, 27*b*, and the yoke 28 constitute an excitation circuit 17 that generates a magnetic field in the tube axis direction of the anode cylinder 21.

Below the magnetic flux collecting plate 26*b* in the tube axis direction, an input part 29 is provided which supplies a filament application power and an operating voltage. Above the magnetic flux collecting plate 26*a* in the tube axis, the output part 18 is provided which emits the microwave from an antenna lead 30. The antenna lead 30 is led out from one anode resonant plate 22. The electric field generated in the interaction space of the cavity resonator formed by the anode resonant plates 22, the magnetic field generated in the tube axis direction by the excitation circuit 17, and the filament application power and the operating voltage supplied from the input part 29, the thermal electrons ejected from the filament 23 orbit in the interaction space to oscillate the microwave. The microwave is emitted from the output part 18 via the antenna lead 30.

The electromagnetic wave generator 2 including the cathode part 11 and the anode part 12 as the oscillating unit main body is a kind of diode that oscillates by controlling the current between coaxial cylindrical electrodes by the magnetic field applied in the tube axis direction. When applying an anode voltage to a coaxial cylindrical diode, electrons ejected from the cathode straight reach the anode. When applying a magnetic field in parallel to an anode-cathode axis, the electrons receive a force at a right angle to the motion direction and the magnetic field direction and draws a curved locus. When the magnetic field becomes further stronger, the electrons graze an anode surface and moves again toward the anode. The magnetic flux density of the magnetic field at this time is called a critical magnetic flux density. This phenomenon also applies to the case of decreasing the anode voltage while keeping a magnetic field fixed, and the electrons do not reach the anode any longer when the anode voltage becomes low. This limit voltage is called a cutoff voltage. Since a current suddenly flows when the anode voltage exceeds the cutoff voltage, the electromagnetic wave generator 2 can be said to be a kind of diode having a high cutoff voltage.

Figure 21:
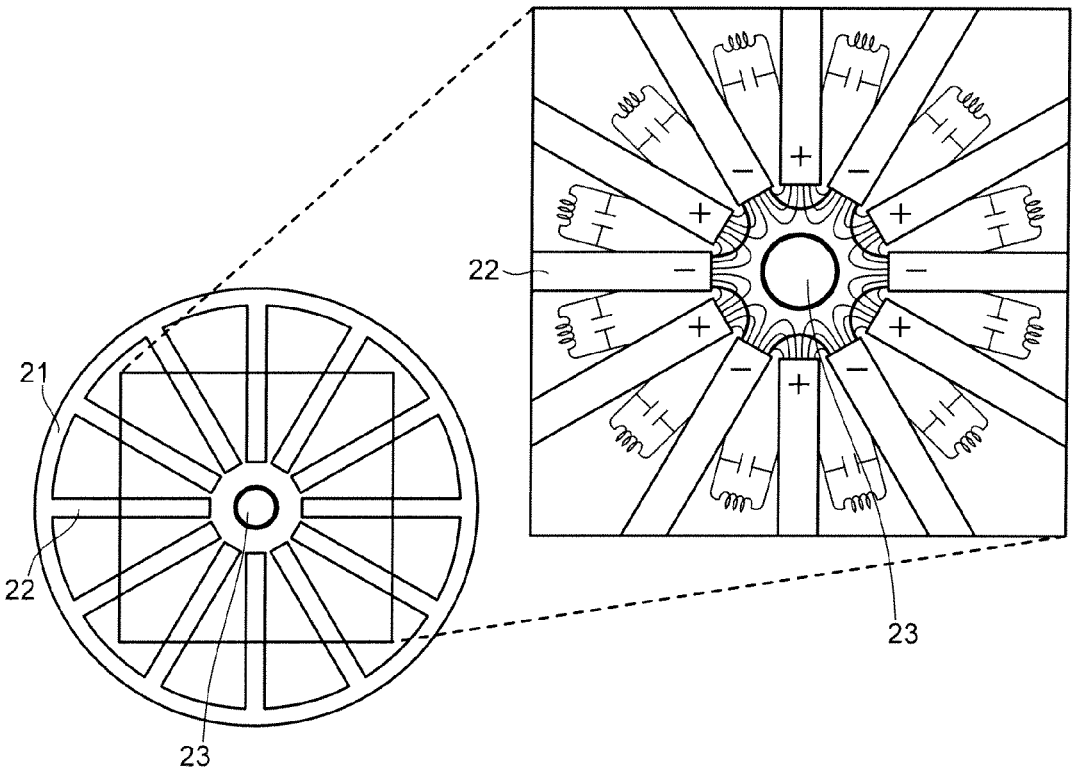
FIG. 21 is a conceptual view of the anode part of the electromagnetic wave generator illustrated in FIG. 19.

The anode part 12 of the electromagnetic wave generator 2 is divided into a plurality of parts and therefore constitutes a resonator expressed by an equivalent circuit of C, L as illustrated in FIG. 21. Between the divided anode resonant plates 22, a weak microwave vibrates even in an non-oscillating state, and high frequency electric fields are oppositely oriented between adjacent anode resonant plates 22 in a normal state. A phase difference between the adjacent anode resonant plates 22 is 180 degrees (π radian) and this state is called a π mode. The high frequency electric field changes in a period of the resonant frequency. By heating the cathode part 11 and applying voltage to the anode part 12, the electrons orbit around the anode part 12. The orbiting speed of the electrons changes by changing the ratio between the anode voltage and the magnetic flux density, so that the orbiting angular speed can be made equal to the change speed of the high frequency electric field (electric field angular speed) in the resonator by adjusting the ratio.

The electrons shrink to the cathode part 11 side in a space having an accelerating electric field and spread to the anode part 12 side in a space having a decelerating electric field and therefore form an electron swarm in a spoke shape. The electrons in the decelerating electric field lose potential energy and converge to the anode part 12 during rotation in synchronism with the rotation period of the high frequency electric field of the resonance circuit, and therefore this electron swarm energizes the resonator to oscillate. In this event, the shape of the electron swarm in the spoke shape changes depending on the number of anode resonant plates 22, and the spoke shape becomes sharper as the number of anode resonant plates 22 is larger. As the spoke shape becomes sharper, the flowing induced current becomes smaller, so that the maximum point of the output efficiency shifts toward a low current region. For this reason, the electromagnetic wave generator 2 has 12 or more anode resonant plates 22.

Figure 19:
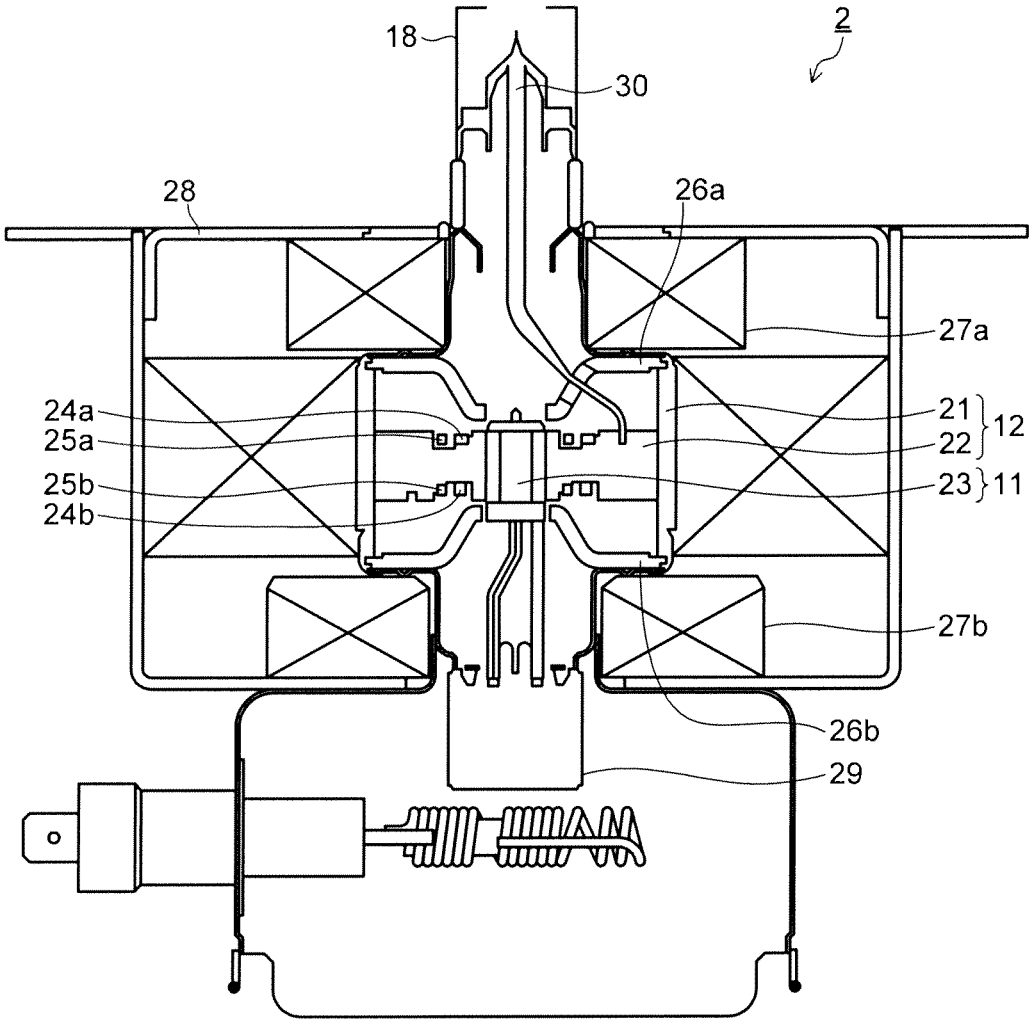
FIG. 19 is a cross-sectional view illustrating a configuration example of the electromagnetic wave generator in the first embodiment.
Figure 20:
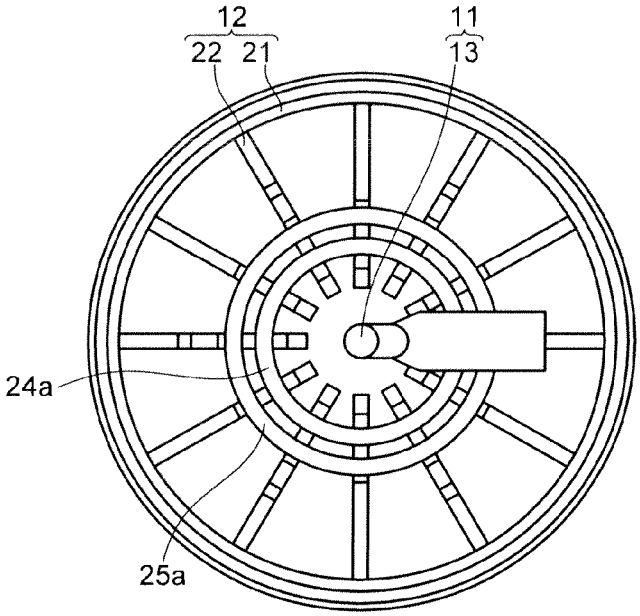
FIG. 20 is a top view illustrating an anode part and a cathode part of the electromagnetic wave generator illustrated in FIG. 19.

FIGS. 19 to 21 illustrates an electromagnetic wave generator 2 having 12 anode resonant plates 22. The anode part 12 having 12 or more anode resonant plates 22 can enhance the output efficiency in a low input power and low current region and decrease the fluctuation range of the output efficiency. An increase in the number of division of the anode resonant plates 22 increases the density per unit of high frequency electric field between the resonant plates, so that the Q value of resonance becomes large. In short, the electronic efficiency improves. Further, an increase in the number of division of the anode resonant plates 22 decreases the allowable value of the flowing induced current, so that the output efficiency becomes maximum in the low current region. From these points, the anode part 12 having 12 or more anode resonant plates 22 is effective in enhancing the output efficiency in the low input power and low current region.

Figure 22:
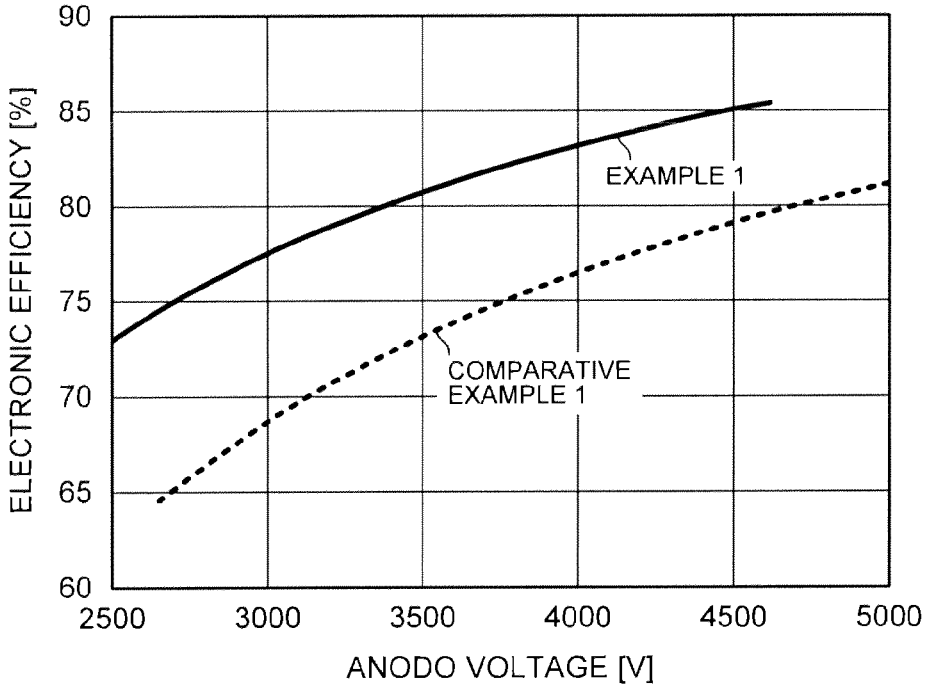
FIG. 22 is a chart illustrating the relation between the operating voltage and the electronic efficiency of the electromagnetic wave generator in the first embodiment.
Figure 23:
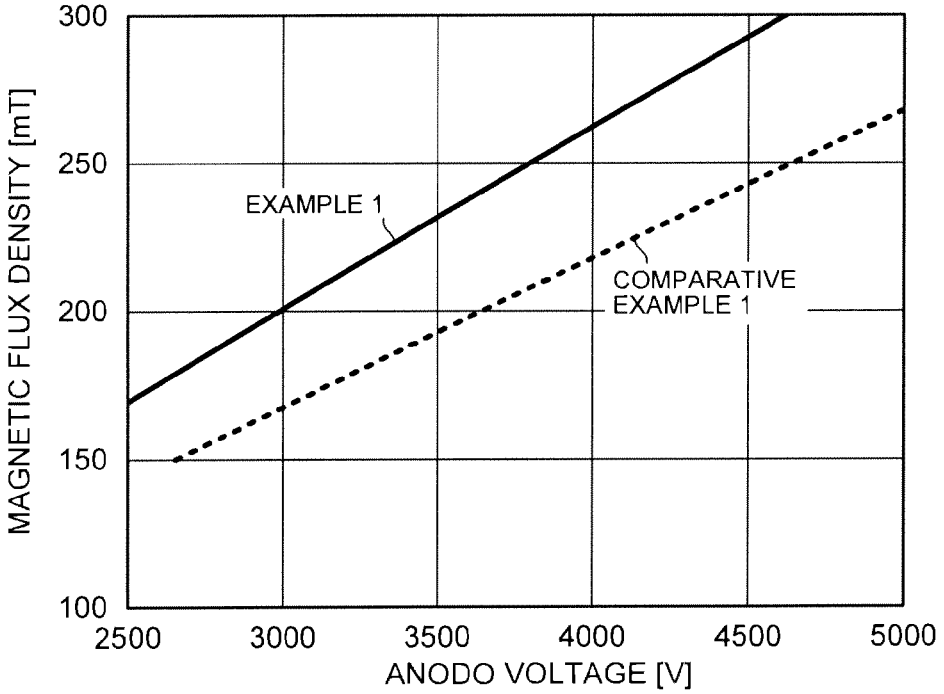
FIG. 23 is a chart illustrating the relation between the operating voltage and the magnetic flux density of the electromagnetic wave generator in the first embodiment.

FIG. 22 and FIG. 23 illustrate the relation between the operating voltage (anode voltage) and the electronic efficiency and the magnetic flux density of the electromagnetic wave generator 2. The thermal electrons ejected from the cathode part 11 are accelerated by the electric field between the cathode part 11 and the anode part 12 to obtain kinetic energy, but perform rotational movement from the influence of the magnetic field perpendicular to the electric field. In the rotational movement, the thermal electrons pass through the tips of the anode resonant plates 22 to cause induced current in the anode part 12. The induced current becomes microwave power. The efficiency of converting the kinetic energy obtained by the electrons from the electric field into microwave energy is called an electronic efficiency. The theoretical formula of an electronic efficiency η e is expressed by the following Expression.

[Mathematical Expression 1]

$$\text{Electronic } efficiency_{\eta_e} = 1 - \frac{1+\sigma}{(2B/B_o) - 1 + \sigma}$$

$$\text{Anode voltage } V_a = \frac{\alpha_1 \times ra^2(1-\sigma^2)}{n\lambda}\left(B - \frac{\alpha_2}{n\lambda}\right)$$

In the above Expression, ra is a radius of an anode inside diameter (2 ra), rc is a radius of a cathode outside diameter (2 rc), σ is a ratio (rc/ra) between the radius (ra) of the anode inside diameter and the radius (rc) of the cathode output diameter, Bo is a critical magnetic flux density, B is a design magnetic flux density, n is a modal number (anode division N/2), $\alpha_1$, $\alpha_2$ are constants, and λ is a wavelength.

FIG. 22 and FIG. 23 are obtained from the above-described two expressions.

In FIG. 22 and FIG. 23, Example is an electromagnetic wave generator having a number of the anode resonant plates 22 of 12 and Comparative Example is an electromagnetic wave generator having a number of the anode resonant plates 22 of 10. The electromagnetic wave generator in Example is found to be high in electronic efficiency though low in anode voltage with respect to a fixed magnetic flux density. In principle, the electronic efficiency increases with a higher magnetic flux density. For example, in the case of an anode voltage of 3.5 kV, the magnetic flux density of the electromagnetic wave generator in Comparative Example is 200 mT or less, whereas the electromagnetic wave generator in Example can achieve further enhancement of the efficiency by using the permanent magnets 27*a*, 27*b* having a magnetic flux density of 230 mT or more.

As described above, employment of the anode part 12 having 12 or more anode resonant plates 22 and the permanent magnets 27*a*, 27*b* having a magnetic flux density of 230 mT or more can realize the electromagnetic wave generator 2 having a maximum output efficiency in the anode current region of 200 mA or less (low current region) of 70% or more and having a fluctuation rate of the output efficiency with respect to the input power in the range of 150 to 700 W of 15% or less as illustrate in Table 1, FIGS. 3 to 7. Further, employment of the electromagnetic wave generator 2 makes it possible to provide the plasma emission device 1 having enhanced total luminous flux and improved efficiency and light control range at light control time as described above.

(Second Embodiment)

Next, a plasma emission device and an electromagnetic wave generator used therein in a second embodiment will be described. The second embodiment is a 300 W-class plasma emission device having improved luminous efficiency and total luminous flux. A basic configuration of the plasma emission device in the second embodiment is the same as that in the first embodiment. More specifically, as illustrated in FIG. 1 and FIG. 2, the plasma emission device 1 in the second embodiment includes an electromagnetic wave generator 2, a power source unit 3 that supplies power to the electromagnetic wave generator 2, a waveguide 4 that transmits an electromagnetic wave emitted from the electromagnetic wave generator 2, an antenna 5 that receives the electromagnetic wave transmitted through the waveguide 4, an electromagnetic wave focuser 6 that is irradiated with the electromagnetic wave from the antenna 5, and a light emitting unit having an electrodeless bulb 7 that is installed in the electromagnetic wave focuser 6.

Incidentally, the 300 W-class plasma emission device is used for interior illumination installed at a relatively low ceiling (for example, 5 m or less), outdoor narrow-area illumination or the like. In the plasma emission device, it is important to enhance the luminous efficiency when light control is performed with a decreased input power in order to correspond to the illuminance from the relatively low ceiling. For this point, the plasma emission device 1 in the second embodiment includes an electromagnetic wave generator 2 having 72% or more of an output efficiency of a microwave to be generated in the whole region of an input power in a range of 100 to 350 W. The electromagnetic wave generator 2 allows the light emitting unit having the electrodeless bulb 7 to efficiently emit light in the whole region of the input power in the range of 100 to 350 W.

Also in the case of light control performed by changing the input power to the plasma emission device 1 in the range of 100 to 350 W, the luminous efficiency of the plasma emission device 1 can be enhanced in the whole region of the light control region. Accordingly, the total luminous flux according to the input power of the plasma emission device 1 improves and the luminous efficiency improves in the whole region of the input power in the range of 100 to 350 W. In other words, it becomes possible to provide the plasma emission device 1 excellent in brightness and energy saving property in the whole region of the input power in the range of 100 to 350 W (low input power region).

To improve the output efficiency of the electromagnetic wave generator 2 in the low input power region (the whole region in the range of 100 to 350 W), it is effective to enhance the output efficiency of the microwave to be generated in a low current region. Concretely, the electromagnetic wave generator 2 preferably generates the microwave in an anode current region in a range of 30 to 150 mA with respect to the input power in the range of 100 to 350 W and has 72% or more of an output efficiency of the microwave in the whole region of the anode current region. Further, to improve the output efficiency in the low input power region of the electromagnetic wave generator 2, the microwave preferably exhibits the maximum output efficiency with an input power in a range of 250 to 300 W. These make it possible to enhance, with high repeatability, the output efficiency of the microwave to be generated in the whole region of the input power in the range of 150 to 300 W.

The electromagnetic wave generator 2 in the second embodiment preferably has 72% or more of an output efficiency of the microwave to be generated in the whole region of the input power in the range of 100 to 350 W, 72% or more of an output efficiency of the microwave to be generated in the whole region of the anode current region in the range of 30 to 150 mA, and the microwave exhibiting the maximum output efficiency with the input power in the range of 250 to 300 W. The output efficiency of the microwave to be generated in the whole region of the input power in the range of 100 to 350 W and the anode current region in the range of 30 to 150 mA is more preferably 74% or more. Use of the electromagnetic wave generator 2 makes it possible to enhance the luminous efficiency of the plasma emission device 1 excellent in energy saving property.

Figure 24:
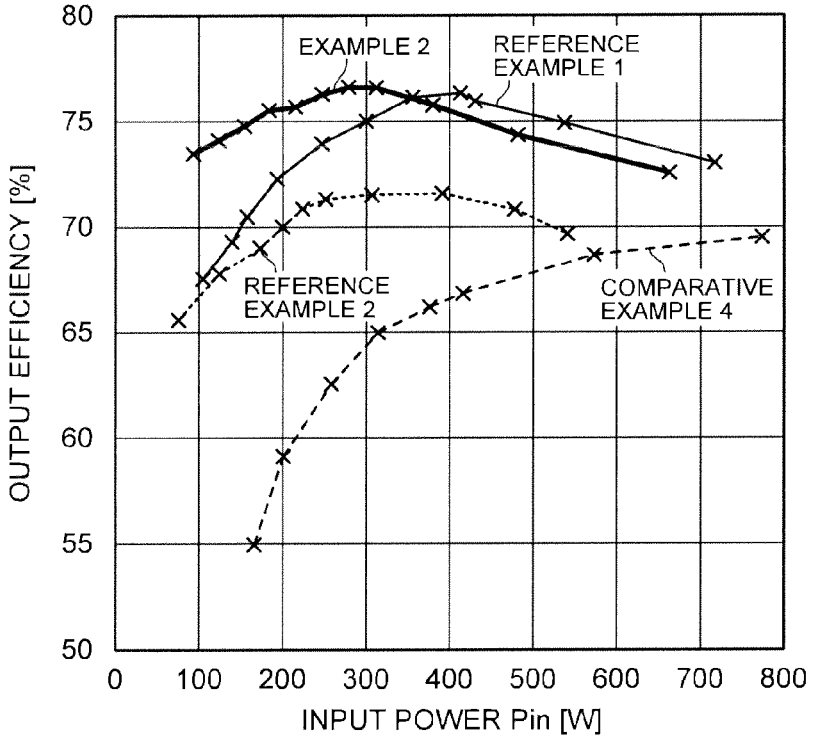
FIG. 24 is a chart illustrating the relation between the input power and the output efficiency of an electromagnetic wave generator in a plasma emission device in a second embodiment.
Figure 25:
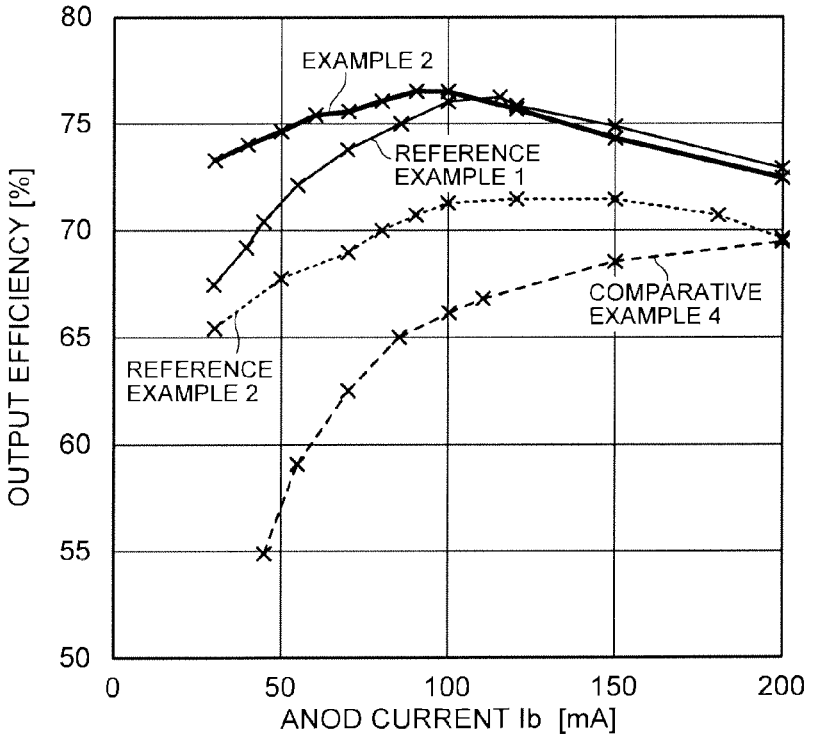
FIG. 25 is a chart illustrating the relation between the anode current and the output efficiency of the electromagnetic wave generator in the plasma emission device in the second embodiment.

Table 5 and FIGS. 24 to 25 illustrate examples of the input power, the anode current, the operating voltage (anode voltage), the output power, the output efficiency of the microwave, and the oscillation frequency of an electromagnetic wave generator 2 according to Example 2. Table 5 and FIGS. 24 to 25 additionally illustrate characteristics of electromagnetic wave generators according to Comparative Example 4 and Reference Examples 1 to 2. The electromagnetic wave generator 2 in Example 2 is found to have an output efficiency of the microwave generated in the whole region of the input power in the range of 100 to 350 W and the whole region of the anode current region in the range of 30 to 150 mA of 72% or more, and further 74% or more. Besides, the input power with which the microwave exhibits the maximum output efficiency is in a range of 250 to 350 W (concretely, around 300 W). The electromagnetic wave generator 2 in Example 2 keeps an operating voltage of the order of 3 to 3.2 kV with respect to the input power in the range of 100 to 350 W.

TABLE 5

| INPUT Pin[W] | ANODE CURRENT Ib[mA] | OPERATING VOLTAGE Eb[kV] | OUTPUT Po[W] | OUTPUT EFFICIENCY [%] | OSCILLATION FREQUENCY [MHz] |
|---|---|---|---|---|---|
| EXAMPLE 2 | | | | | |
| 91 | 30 | 3.04 | 67 | 73.4 | 2460 |
| 122 | 40 | 3.04 | 90 | 74.0 | 2460 |
| 153 | 50 | 3.05 | 114 | 74.7 | 2461 |
| 183 | 60 | 3.05 | 138 | 75.4 | 2463 |
| 214 | 70 | 3.06 | 162 | 75.6 | 2464 |
| 246 | 80 | 3.07 | 187 | 76.1 | 2465 |
| 278 | 90 | 3.09 | 213 | 76.6 | 2466 |
| 311 | 100 | 3.11 | 238 | 76.5 | 2467 |
| 379 | 120 | 3.16 | 287 | 75.7 | 2468 |
| 481 | 150 | 3.21 | 358 | 74.4 | 2470 |
| 662 | 200 | 3.31 | 480 | 72.5 | 2470 |
| REFERENCE EXAMPLE 1 | | | | | |
| 105 | 30 | 3.50 | 71 | 67.5 | 2453 |
| 140 | 40 | 3.50 | 97 | 69.3 | 2453 |
| 158 | 45 | 3.50 | 111 | 70.5 | 2453 |
| 193 | 55 | 3.50 | 139 | 72.2 | 2454 |

TABLE 5-continued

| INPUT Pin[W] | ANODE CURRENT Ib[mA] | OPERATING VOLTAGE Eb[kV] | OUTPUT Po[W] | OUTPUT EFFICIENCY [%] | OSCILLATION FREQUENCY [MHz] |
|---|---|---|---|---|---|
| 246 | 70 | 3.52 | 182 | 73.9 | 2458 |
| 300 | 85 | 3.53 | 225 | 75.0 | 2461 |
| 355 | 100 | 3.55 | 270 | 76.1 | 2463 |
| 412 | 115 | 3.58 | 314 | 76.3 | 2465 |
| 430 | 120 | 3.59 | 327 | 75.9 | 2466 |
| 537 | 150 | 3.65 | 410 | 74.9 | 2467 |
| 716 | 200 | 3.70 | 540 | 73.0 | 2469 |
| COMPARATIVE EXAMPLE 4 | | | | | |
| 166 | 45 | 3.68 | 91 | 55.0 | 2437 |
| 203 | 55 | 3.69 | 120 | 59.1 | 2439 |
| 259 | 70 | 3.70 | 162 | 62.5 | 2442 |
| 317 | 85 | 3.73 | 206 | 65.0 | 2447 |
| 375 | 100 | 3.75 | 248 | 66.1 | 2452 |
| 415 | 110 | 3.77 | 277 | 66.8 | 2454 |
| 572 | 150 | 3.81 | 392 | 68.6 | 2458 |
| 774 | 200 | 3.87 | 538 | 69.5 | 2461 |
| REFERENCE EXAMPLE 2 | | | | | |
| 74 | 30 | 2.45 | 48 | 65.5 | 2450 |
| 123 | 50 | 2.45 | 83 | 67.8 | 2450 |
| 172 | 70 | 2.46 | 119 | 69.0 | 2452 |
| 198 | 80 | 2.47 | 138 | 70.0 | 2455 |
| 223 | 90 | 2.48 | 158 | 70.8 | 2458 |
| 250 | 100 | 2.50 | 178 | 71.3 | 2461 |
| 306 | 120 | 2.55 | 219 | 71.5 | 2462 |
| 390 | 150 | 2.60 | 279 | 71.5 | 2462 |
| 477 | 180 | 2.65 | 338 | 70.8 | 2463 |
| 540 | 200 | 2.70 | 376 | 69.7 | 2465 |

In the electromagnetic wave generator in Reference Example 1, an output efficiency of 72% or more is kept in a region of the input power down to approximately 200 W but significantly decreases when the input power is below 200 W, so that the output efficiency is less than 72%. Besides, the input power with which the microwave exhibits the maximum output efficiency is over 300 W and around 400 W. The electromagnetic wave generators in Reference Example 2 and Comparative Example 4 are found to have an output efficiency of less than 72% in the whole region of the input power in the range of 100 to 350 W. Based on the differences in output efficiency, the electromagnetic wave generator 2 in Example 2 is excellent in output characteristics in the low lower region as compared with the electromagnetic wave generators in Comparative Example 4 and Reference Examples 1 to 2. Note that the differences in concrete configuration between the electromagnetic wave generator 2 in Example 2, and, the electromagnetic wave generators in Comparative Example 4 and Reference Examples 1 to 2 are as illustrated in Table 6. The differences in configuration will be described later in detail.

TABLE 6

| | OPERATING VOLTAGE [kV] | MAGNETIC FLUX DENSITY [mT] | NUMBER OF ANODE RESONANT PLATES | $r_c/r_a$ |
|---|---|---|---|---|
| Example 2 | 2.8~3.3 | 230~260 | 12 | 0.487 |
| Reference Example 1 | 3.3~3.8 | <230 | 12 | 0.481 |
| Comparative Example 4 | 3.6~3.9 | 160~200 | 10 | 0.443 |
| Reference Example 2 | 2.3~2.7 | 160~180 | 12 | 0.481 |

Figure 26:
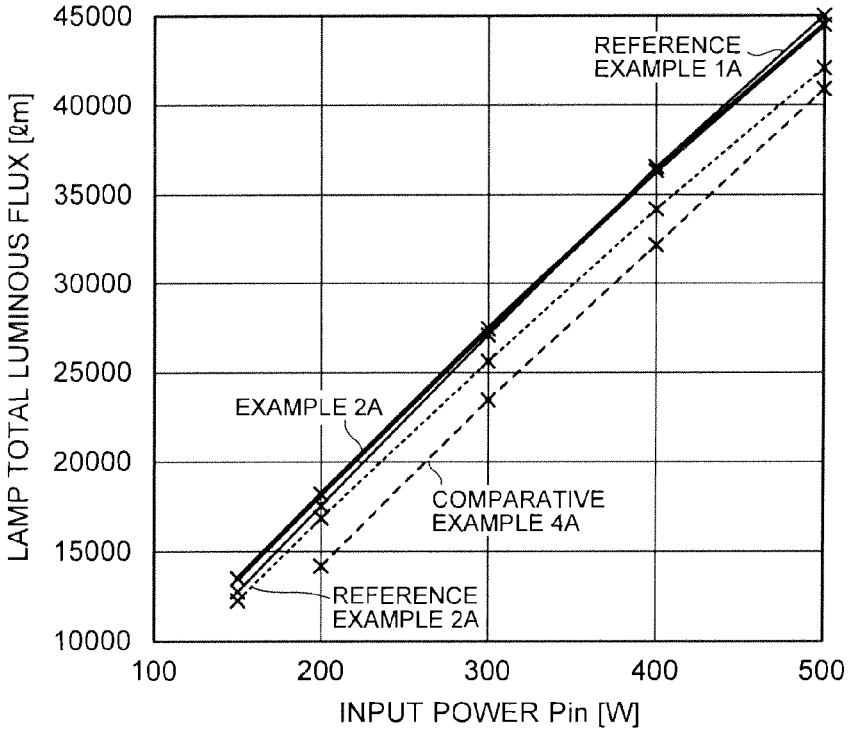
FIG. 26 is a chart illustrating the relation between the input power and the total luminous flux of the plasma emission device in the second embodiment.
Figure 27:
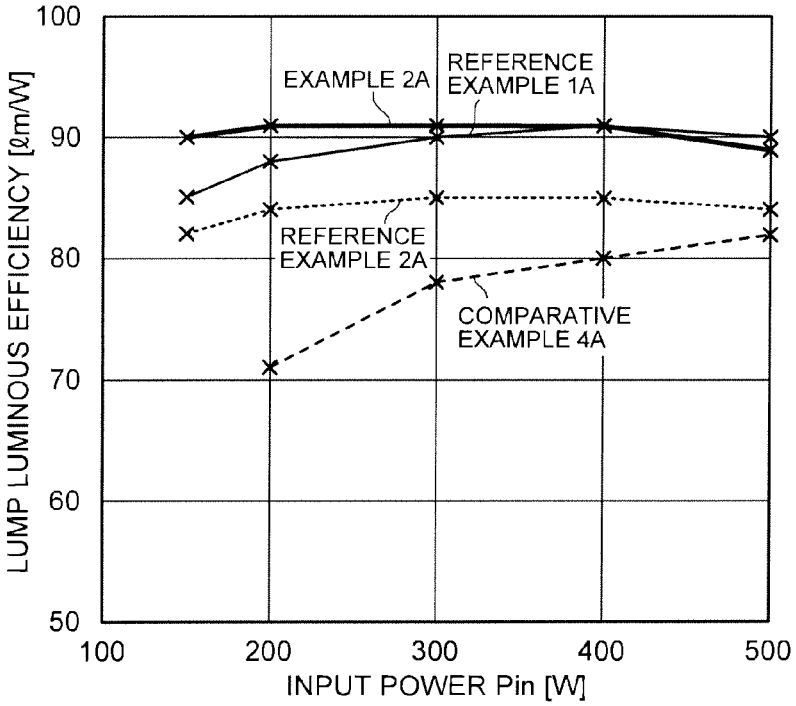
FIG. 27 is a chart illustrating the relation between the input power and the luminous efficiency (lamp efficiency) of the plasma emission device in the second embodiment.

Table 7 and FIG. 26 illustrate the relation between the input power and the total luminous flux [unit: lumen (lm)] of the plasma emission device (Example 2A) using the electromagnetic wave generator in Example 2. Table 7 and FIG. 27 illustrate the relation between the input power and the luminous efficiency (lamp efficiency [unit: lm/W]) of the plasma emission device (Example 2A) using the electromagnetic wave generator in Example 2. These table and drawings additionally illustrate characteristics of plasma emission devices (Comparative Example 4A, Reference Examples 1A, 2A) using the electromagnetic wave generators in Comparative Example 4, Reference Examples 1 to 2. The plasma emission device in Example 2A is found to be excellent in luminous efficiency and total luminous flux with an input power of 350 W or less as compared with the plasma emission devices in Comparative Example 4A and Reference Examples 1A to 2A.

TABLE 7

| INPUT Pin[W] | LAMP TOTAL LUMINOUS FLUX [lm] | LAMP LUMINOUS EFFICIENCY [lm/W] |
|---|---|---|
| EXAMPLE 2A | | |
| 150 | 13500 | 90 |
| 200 | 18120 | 91 |
| 300 | 27360 | 91 |
| 400 | 36240 | 91 |
| 500 | 44400 | 89 |
| REFERENCE EXAMPLE 1A | | |
| 150 | 12700 | 85 |
| 200 | 17520 | 88 |
| 300 | 27000 | 90 |
| 400 | 36480 | 91 |
| 500 | 45000 | 90 |
| 700 | 61740 | 88 |
| COMPARATIVE EXAMPLE 4A | | |
| 200 | 14160 | 71 |
| 300 | 23400 | 78 |
| 400 | 36160 | 80 |
| 500 | 40800 | 82 |
| 700 | 57960 | 83 |
| REFERENCE EXAMPLE 2A | | |
| 150 | 12240 | 82 |
| 200 | 16800 | 84 |
| 300 | 25560 | 85 |
| 400 | 34080 | 85 |
| 500 | 42000 | 84 |

Table 7 and FIG. 26 and FIG. 27 correspond to the total luminous flux and the lamp luminous efficiency in the case of light control performed by changing the input power to the plasma emission device 1. As illustrated in Table 7 and FIG. 26 and FIG. 27, in the electromagnetic wave generator 2 having an output efficiency of the microwave to be generated in the whole region of the input power in the range of 100 to 350 W of 72% or more, the lamp luminous efficiency is kept also in the case of changing the input power in the range of 350 W or less in order to adjust the brightness (light control) of the plasma emission device 1. In other words, the plasma emission device 1 using the electromagnetic wave generator 2 in Example 2 is excellent in luminous efficiency and total luminous flux at light control time. Accordingly, it becomes possible to suppress an increase in power consumption and so on with a decrease in luminous efficiency at light control time.

As described above, employing the electromagnetic wave generator 2 having an output efficiency of the microwave to be generated in the whole region of the input power in the range of 100 to 350 W of 72% or more makes it possible to improve the luminous efficiency and the total luminous flux of the plasma emission device 1 with a 300 W-class input power. It also becomes possible to efficiently perform light control of the 300 W-class plasma emission device 1 with the input power in the range of 100 to 350 W. Use of the plasma emission device in the second embodiment makes it possible to provide an illumination device suitable for interior illumination installed at a relatively low ceiling (for example, 5 m or less) of a store, a warehouse or the like, outdoor narrow-area illumination or the like. However, the plasma emission device 1 in the second embodiment is not limited to the illumination device but may be applied to a light source of a projector or the like.

The plasma emission device 1 in the second embodiment is suitable for an illumination device such as illumination for a relatively low ceiling, narrow-area illumination, or the like, similarly to the HID such as a high-pressure mercury lamp, a metal halide lamp, a high-pressure sodium lamp or the like. Further, the plasma emission device 1 is light-controllable with the input power in the range of 100 to 350 W and is therefore excellent in energy saving property as compared with the HID, and the plasma emission device 1 uses the light emitting unit having the electrodeless bulb 7 and is therefore excellent in lifetime characteristics. Accordingly, the plasma emission device 1 in the second embodiment is effective as an energy-saving illumination device that embodies decreased power consumption by improving the energy efficiency and decreased device cost and maintenance cost by extending the lifetime.

A concrete configuration of the electromagnetic wave generator 2 used in the plasma emission device 1 in the second embodiment is the same as that in the first embodiment. The electromagnetic wave generator 2 in the second embodiment includes the cathode part 11 and the anode part 12 as an oscillating unit main body as illustrated in FIGS. 19 and 20. The anode part 12 has an anode cylinder 21 and a plurality of anode resonant plates 22 radially arranged at regular intervals from an inner wall of the anode cylinder 21 toward its tube axis. The cathode part 11 has a filament 23 disposed on the inside of the anode cylinder 21 along the tube axis. Configurations other than them are also the same as those in the first embodiment and their details are as have been described above.

As has been described above, the anode part 12 is divided into a plurality of parts and therefore constitutes a resonator expressed by an equivalent circuit of C, L. By heating the cathode part 11 and applying voltage to the anode part 12, electrons orbit around the anode part 12. The orbiting speed of the electrons changes by changing the ratio between the anode voltage and the magnetic flux density, so that the orbiting angular speed can be made equal to the change speed of the high frequency electric field in the resonator by adjusting the ratio. The electrons shrink to the cathode part 11 side in a space having an accelerating electric field and spread to the anode part 12 side in a space having a decelerating electric field and therefore form an electron swarm in a spoke shape. The shape of the electron swarm in the spoke shape becomes sharper as the number of anode resonant plates 22 is larger. As the spoke shape becomes sharper, the flowing induced current becomes smaller, so that the maximum point of the output efficiency shifts toward a low current region. For this reason, the electromagnetic wave generator 2 has 12 anode resonant plates 22.

The electromagnetic wave generator 2 in the second embodiment has 12 anode resonant plates 22 as illustrated in FIG. 20. The anode part 12 having 12 anode resonant plates 22 can enhance the output efficiency in a low power region and a low current region. An increase in the number of division of the anode resonant plates 22 increases the density per unit of high frequency electric field between the resonant plates, so that the electronic efficiency improves. An increase in the number of division of the anode resonant plates 22 decreases the allowable value of the flowing induced current, so that the output efficiency becomes maximum in the low current region.

Further, to obtain, in the 300 W-class plasma emission device 1, the luminous efficiency equal to that of the 400 W-class, it is necessary to shift the maximum point of the output efficiency toward a lower current region. To this end, it is preferable to decrease the anode inside diameter (2 ra) to increase the ratio (rc/ra) between the radius (ra) of the anode inside diameter and the radius (rc) of the cathode outside diameter (2 rc). This can decrease the anode voltage with respect to the same magnetic field. The rc/ra ratio is preferably 0.487 or more. Here, the anode inside diameter (2 ra) means the inside diameter of the inner end portions (free ends) of the plurality of anode resonant plates 22. Further, in the case of using 12 anode resonant plates 22, L of the resonator increases and the Q value also decreases. Further, by decreasing the anode inside diameter (2 ra), C of the resonator increases and the Q value further decreases. Therefore, the anode current with which the microwave exhibits the maximum output efficiency can shift to a lower current side.

From these points, to enhance the output efficiency of the electromagnetic wave generator 2 in the low power region of 350 W or less and a low current region of 150 mA or less, it is preferable to employ the anode part 12 having 12 anode resonant plates 22 and set the rc/ra ratio to 0.487 or more. The above-described electromagnetic wave generator 2 in Example 2 has 12 anode resonant plates 22 and an rc/ra ratio of 0.487 as illustrated in Table 6. On the other hand, each of the electromagnetic wave generators in Reference Examples 1, 2 has a number of the anode resonant plates 22 of 12 but an rc/ra ratio of 0.481. Further, the electromagnetic wave generator in Comparative Example 4 has an operating voltage of as low as 2.3 to 2.7 V. The electromagnetic wave generator in Comparative Example 4 has a number of the anode resonant plates of 10 and a re/ra ratio of 0.443.

Based on the above-described differences in concrete configuration of the electromagnetic wave generator, it is found that the input power with which the microwave exhibits the maximum output efficiency is shifted to a lower current side in the electromagnetic wave generator 2 in Example 2 as compared with that of Reference Example 1. On the basis of the relation between the input power and the output efficiency, the electromagnetic wave generator 2 in Example 2 realizes the configuration that the output efficiency of the microwave in the whole region of the input power in the range of 100 to 350 W and the whole region of the anode current region in the range of 30 to 150 mA is 72% or more. Note that the electromagnetic wave generator in Comparative Example 4 has a number of the anode resonant plates of 10 and the electromagnetic wave generator in Reference Example 2 has a low operating voltage, and are therefore found to have generally low in output efficiency of the microwave with the input power in the range of 100 to 350 W.

(Third Embodiment)

Next, a plasma emission device and an electromagnetic wave generator used therein in a third embodiment will be described. The third embodiment is a 400 W-class plasma emission device having further improved luminous efficiency and total luminous flux. A basic configuration of the plasma emission device in the third embodiment is the same as that in the first embodiment. More specifically, as illustrated in FIG. 1 and FIG. 2, the plasma emission device 1 in the third embodiment includes an electromagnetic wave generator 2, a power source unit 3 that supplies power to the electromagnetic wave generator 2, a waveguide 4 that transmits an electromagnetic wave emitted from the electromagnetic wave generator 2, an antenna 5 that receives the electromagnetic wave transmitted through the waveguide 4, an electromagnetic wave focuser 6 that is irradiated with the electromagnetic wave from the antenna 5, and a light emitting unit having an electrodeless bulb 7 that is installed in the electromagnetic wave focuser 6.

Incidentally, the 400 W-class plasma emission device is used for interior illumination installed at a high ceiling (for example, 5 m or more) of a warehouse or the like, outdoor area illumination for road and street or the like. In the plasma emission device, it is important to enhance the luminous efficiency on a low power side in the case of performing light control with the input power as well as to improve the luminous efficiency with respect to the input power. For these points, the plasma emission device 1 in the third embodiment includes an electromagnetic wave generator 2 having an output efficiency of a microwave to be generated in the whole region of an input power in a range of 100 to 500 W of 72% or more. The electromagnetic wave generator 2 allows the light emitting unit having the electrodeless bulb 7 to efficiently emit light in the whole region of the input power in the range of 100 to 500 W.

Also in the case of light control performed by changing the input power to the plasma emission device 1 in the range of 100 to 500 W, the luminous efficiency of the plasma emission device 1 can be further enhanced in the whole region of the light control region. Accordingly, the total luminous flux according to the input power of the plasma emission device 1 improves and the luminous efficiency improves in the whole region of the input power in the range of 100 to 500 W. In other words, it becomes possible to provide the plasma emission device 1 excellent in brightness and energy saving property in the whole region of the input power in the range of 100 to 500 W.

To improve the output efficiency of the electromagnetic wave generator 2 in the whole region of the input power (the whole region in the range of 100 to 500 W), it is effective to enhance the output efficiency of the microwave to be generated in a low current region. Concretely, the electromagnetic wave generator 2 preferably generates the microwave in an anode current region in a range of 30 to 200 mA with respect to the input power in the range of 100 to 500 W and has an output efficiency of the microwave in the whole region of the anode current region of 72% or more. Further, to improve the output efficiency on the low input power region side of the electromagnetic wave generator 2, the microwave preferably exhibits the maximum output efficiency with an input power in a range of 200 to 300 W. These make it possible to enhance, with high repeatability, the output efficiency of the microwave to be generated in the whole region of the input power in the range of 100 to 500 W.

The electromagnetic wave generator 2 in the third embodiment preferably has an output efficiency of the microwave to be generated in the whole region of the input power in the range of 100 to 500 W of 72% or more, an output efficiency of the microwave to be generated in the whole region of the anode current region in the range of 30 to 200 mA of 72% or more, and the microwave exhibiting the maximum output efficiency with the input power in the range of 200 to 300 W. The output efficiency of the microwave to be generated in the whole region of the input power in the range of 100 to 500 W and the anode current region in the range of 30 to 200 mA is more preferably 74% or more. Use of the electromagnetic wave generator 2 makes it possible to enhance the luminous efficiency of the plasma emission device 1 excellent in energy saving property and so on.

Figure 28:
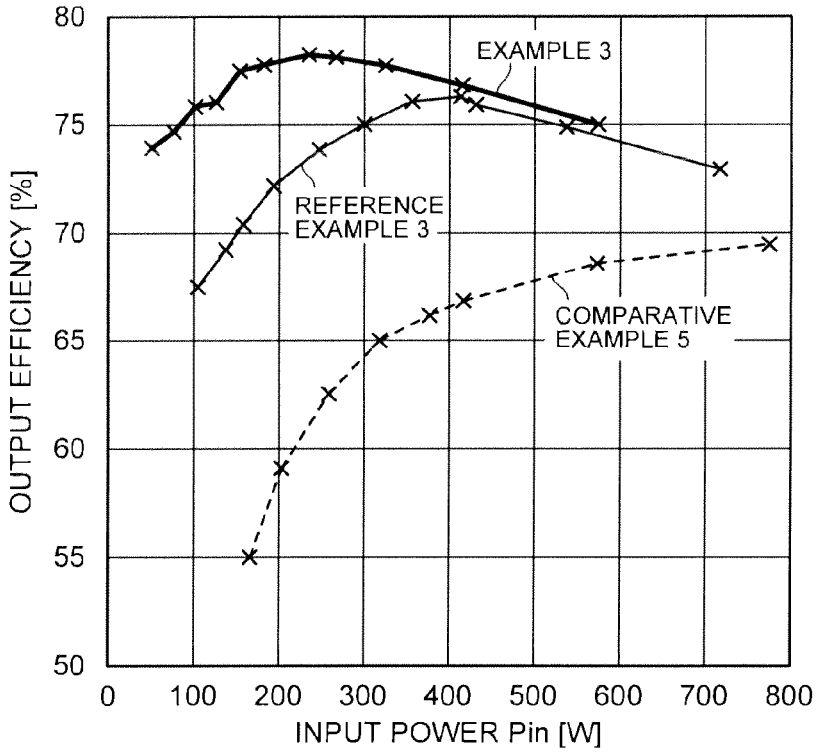
FIG. 28 is a chart illustrating the relation between the input power and the output efficiency of an electromagnetic wave generator in a plasma emission device in a third embodiment.
Figure 29:
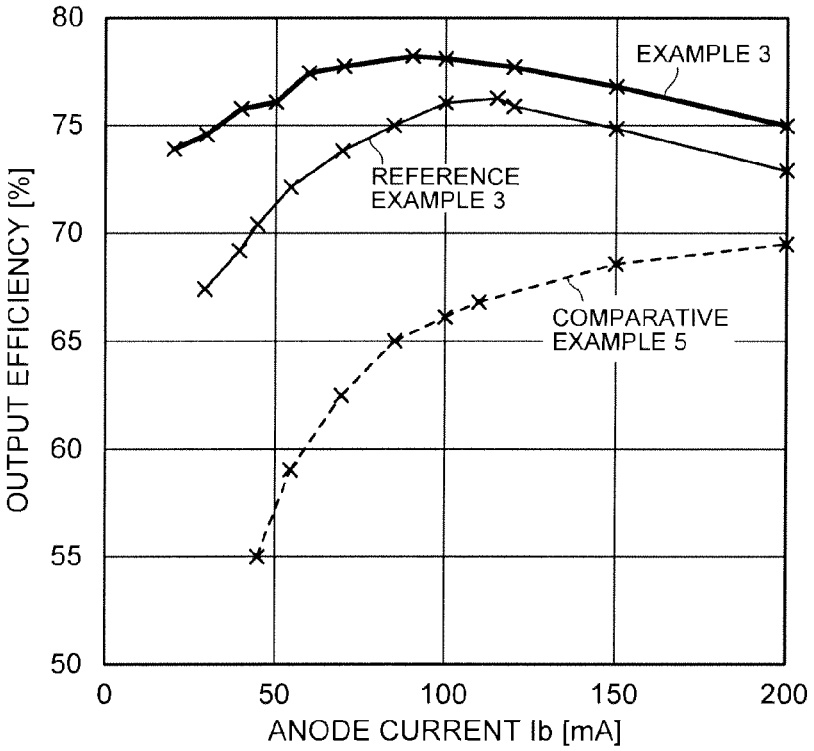
FIG. 29 is a chart illustrating the relation between the anode current and the output efficiency of the electromagnetic wave generator in the plasma emission device in the third embodiment.

Table 8 and FIGS. 28 to 29 illustrate examples of the input power, the anode current, the operating voltage (anode voltage), the output power, the output efficiency of the microwave, and the oscillation frequency of an electromagnetic wave generator 2 according to Example 3. Note that Table 8 and FIGS. 28 to 29 additionally illustrate characteristics of electromagnetic wave generators according to Reference Example 3 and Comparative Example 5. The electromagnetic wave generator 2 in Example 3 is found to have output efficiency of the microwave generated in the whole region of the input power in the range of 100 to 500 W and the whole region of the anode current region in the range of 30 to 200 mA of 72% or more, and further 74% or more. Besides, the input power with which the microwave exhibits the maximum output efficiency is in a range of 200 to 300 W (concretely, around 235 W). The electromagnetic wave generator 2 in Example 3 keeps an operating voltage of the order of 2.5 to 3 kV with respect to the input power in the range of 100 to 500 W.

TABLE 8

| INPUT Pin[W] | ANODE CURRENT Ib[mA] | OPERATING VOLTAGE Eb[kV] | OUTPUT Po[W] | OUTPUT EFFICIENCY [%] | OSCILLATION FREQUENCY [MHz] |
|---|---|---|---|---|---|
| EXAMPLE 3 | | | | | |
| 50 | 20 | 2.50 | 37 | 74.0 | 2460 |
| 75 | 30 | 2.50 | 56 | 74.6 | 2461 |
| 100 | 40 | 2.51 | 76 | 75.8 | 2464 |
| 127 | 50 | 2.55 | 97 | 76.1 | 2467 |
| 154 | 60 | 2.56 | 119 | 77.5 | 2468 |
| 181 | 70 | 2.59 | 141 | 77.8 | 2470 |
| 234 | 90 | 2.60 | 183 | 78.2 | 2470 |
| 265 | 100 | 2.65 | 207 | 78.1 | 2471 |
| 324 | 120 | 2.70 | 252 | 77.8 | 2471 |
| 414 | 150 | 2.76 | 318 | 76.8 | 2471 |
| 570 | 200 | 2.85 | 428 | 75.1 | 2471 |
| REFERENCE EXAMPLE 3 | | | | | |
| 105 | 30 | 3.50 | 71 | 67.5 | 2453 |
| 140 | 40 | 3.50 | 97 | 69.3 | 2453 |
| 158 | 45 | 3.50 | 111 | 70.5 | 2453 |
| 193 | 55 | 3.50 | 139 | 72.2 | 2454 |
| 246 | 70 | 3.52 | 182 | 73.9 | 2458 |
| 300 | 85 | 3.53 | 225 | 75.0 | 2461 |
| 355 | 100 | 3.55 | 270 | 76.1 | 2463 |
| 412 | 115 | 3.58 | 314 | 76.3 | 2465 |
| 430 | 120 | 3.59 | 327 | 75.9 | 2466 |
| 537 | 150 | 3.65 | 410 | 74.9 | 2467 |
| 716 | 200 | 3.70 | 540 | 73.0 | 2469 |
| COMPARATIVE EXAMPLE 5 | | | | | |
| 166 | 45 | 3.68 | 91 | 55.0 | 2437 |
| 203 | 55 | 3.69 | 120 | 59.1 | 2439 |
| 259 | 70 | 3.70 | 162 | 62.5 | 2442 |
| 317 | 85 | 3.73 | 206 | 65.0 | 2447 |
| 375 | 100 | 3.75 | 248 | 66.1 | 2452 |
| 415 | 110 | 3.77 | 277 | 66.8 | 2454 |
| 572 | 150 | 3.81 | 392 | 68.6 | 2458 |
| 774 | 200 | 3.87 | 538 | 69.5 | 2461 |

On the other hand, in the electromagnetic wave generator in Reference Example 3, an output efficiency of 72% or more is kept in a region of the input power down to approximately 200 W but significantly decreases when the input power is below 200 W, so that the output efficiency is less than 72%. Besides, the input power with which the microwave exhibits the maximum output efficiency is over 300 W and around 400 W. The electromagnetic wave generator in Comparative Example 5 is found to have an output efficiency of less than 72% in the whole region of the input power in the range of 100 to 500 W. Based on the differences in output efficiency, the electromagnetic wave generator 2 in Example 3 is excellent in output characteristics as compared with the electromagnetic wave generators in Reference Example 3 and Comparative Example 5. Note that the differences in concrete configuration between the electromagnetic wave generator 2 in Example 3, and, the electromagnetic wave generators in Reference Example 3 and Comparative Example 5 are as illustrated in Table 9. The differences in configuration will be described later in detail.

TABLE 9

| | OPERATING VOLTAGE [kV] | MAGNETIC FLUX DENSITY [mT] | NUMBER OF ANODE RESONANT PLATES | $r_c/r_a$ |
|---|---|---|---|---|
| Example 3 | 2.4~2.8 | 230 | 14 | 0.500 |
| Reference Example 3 | 3.3~3.8 | <230 | 12 | 0.481 |
| Comparative Example 5 | 3.6~3.9 | 160~200 | 10 | 0.443 |

Figure 30:
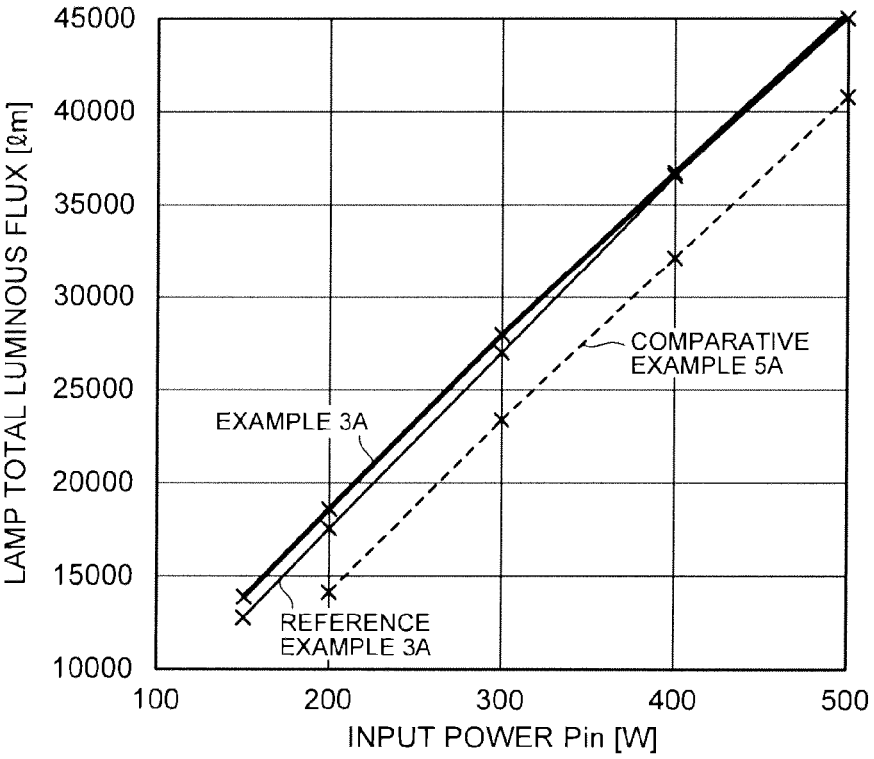
FIG. 30 is a chart illustrating the relation between the input power and the total luminous flux of the plasma emission device in the third embodiment.
Figure 31:
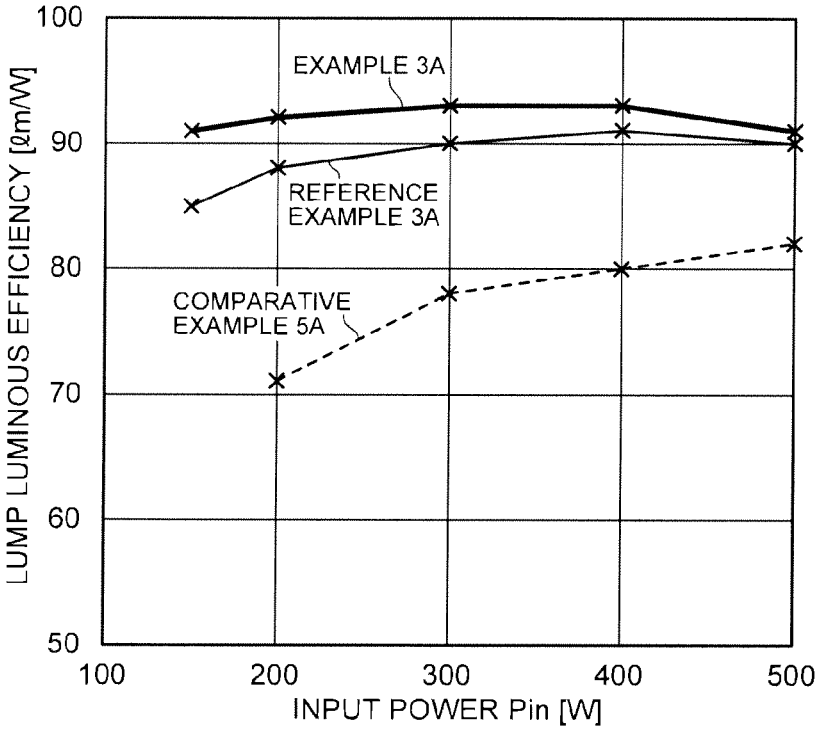
FIG. 31 is a chart illustrating the relation between the input power and the luminous efficiency (lamp efficiency) of the plasma emission device in the third embodiment.

Table 10 and FIG. 30 illustrate the relation between the input power and the total luminous flux [unit: lumen (lm)] of the plasma emission device (Example 3A) using the electromagnetic wave generator in Example 3. Table 10 and FIG. 31 illustrate the relation between the input power and the luminous efficiency (lamp efficiency [unit: lm/W]) of the plasma emission device (Example 3A) using the electromagnetic wave generator in Example 3. These table and drawings additionally illustrate characteristics of plasma emission devices (Comparative Example 3A, Reference Example 5A) using electromagnetic wave generators in Reference Example 3 and Comparative Example 5. The plasma emission device 1 in Example 3A is found to be excellent in total luminous flux and luminous efficiency in the whole region of the input power in the range of 100 to 500 W as compared with the plasma emission devices in Comparative Examples 3A, 5A.

TABLE 10

| INPUT Pin[W] | LAMP TOTAL LUMINOUS FLUX [lm] | LAMP LUMINOUS EFFICIENCY [lm/W] |
|---|---|---|
| EXAMPLE 3A | | |
| 150 | 13680 | 91 |
| 200 | 18600 | 92 |
| 300 | 27900 | 93 |
| 400 | 36720 | 93 |
| 500 | 45300 | 91 |
| REFERENCE EXAMPLE 3A | | |
| 150 | 12780 | 85 |
| 200 | 17520 | 88 |
| 300 | 27000 | 90 |
| 400 | 36480 | 91 |

TABLE 10-continued

| INPUT Pin[W] | LAMP TOTAL LUMINOUS FLUX [lm] | LAMP LUMINOUS EFFICIENCY [lm/W] |
|---|---|---|
| 500 | 45000 | 90 |
| 700 | 61740 | 88 |
| COMPARATIVE EXAMPLE 5A | | |
| 200 | 14100 | 71 |
| 300 | 23400 | 78 |
| 400 | 32160 | 80 |
| 500 | 40800 | 82 |
| 700 | 57960 | 83 |

Table 10 and FIG. 30 and FIG. 31 correspond to the total luminous flux and the luminous efficiency in the case of light control performed by changing the input power to the plasma emission device 1. As illustrated in Table 10 and FIG. 30 and FIG. 31, in the electromagnetic wave generator 2 having an output efficiency of the microwave to be generated in the whole region of the input power in the range of 100 to 500 W of 72% or more, the lamp luminous efficiency is kept also in the case of changing the input power in order to adjust the brightness (light control) of the plasma emission device 1. In other words, the plasma emission device 1 using the electromagnetic wave generator 2 in Example 3 is excellent in total luminous flux and luminous efficiency at light control time. Accordingly, it becomes possible to suppress an increase in power consumption and so on with a decrease in luminous efficiency at the light control time.

As described above, employing the electromagnetic wave generator 2 having an output efficiency of the microwave to be generated in the whole region of the input power in the range of 100 to 500 W of 72% or more makes it possible to not only improve the total luminous flux of the plasma emission device 1 but also efficiently perform light control of the plasma emission device 1. The plasma emission device 1 in the third embodiment is suitable for an illumination device required to have a high output such as interior illumination installed at a high ceiling (for example, 5 m or more) of a warehouse or the like, outdoor area illumination for road and street or the like. However, the plasma emission device 1 in the third embodiment is not limited to the illumination device but may be applied to a light source of a projector or the like.

The plasma emission device 1 in the third embodiment is suitable for a high-output illumination device for high-ceiling illumination, area illumination or the like, similarly to the HID such as a high-pressure mercury lamp, a metal halide lamp, a high-pressure sodium lamp or the like. Further, the plasma emission device 1 is light-controllable with the input power in the range of 100 to 500 W and is therefore excellent in energy saving property as compared with the HID, and the plasma emission device 1 uses the light emitting unit having the electrodeless bulb 7 and is therefore excellent in lifetime characteristics. Accordingly, the plasma emission device 1 in the third embodiment is effective as an energy-saving illumination device that embodies decreased power consumption by improving the energy efficiency and decreased device cost and maintenance cost by extending the lifetime.

A concrete configuration of the electromagnetic wave generator 2 used in the plasma emission device 1 in the third embodiment is the same as that in the first embodiment except that the number of anode resonant plates 22. The electromagnetic wave generator 2 in the third embodiment includes the cathode part 11 and the anode part 12 as an oscillating unit main body as illustrated in FIG. 19. The anode part 12 has an anode cylinder 21 and a plurality of anode resonant plates 22 radially arranged at regular intervals from an inner wall of the anode cylinder 21 toward its tube axis. The cathode part 11 has a filament 23 disposed on the inside of the anode cylinder 21 along the tube axis. Configurations other than them are also the same as those in the first embodiment.

As has been described above, the electrons shrink to the cathode part 11 side in a space having an accelerating electric field and spread to the anode part 12 side in a space having a decelerating electric field and therefore form an electron swarm in a spoke shape. The electrons in the decelerating electric field lose potential energy and converge to the anode part 12 during rotation in synchronism with the rotation period of the high frequency electric field of the resonance circuit, and therefore this electron swarm energizes the resonator to oscillate. The shape of the electron swarm in the spoke shape changes depending on the number of anode resonant plates 22, and the spoke shape becomes sharper as the number of anode resonant plates 22 is larger. As the spoke shape becomes sharper, the flowing induced current becomes smaller, so that the maximum point of the output efficiency shifts toward a low current region. The electromagnetic wave generator 2 in the third embodiment has 14 or more anode resonant plates 22.

Figure 32:
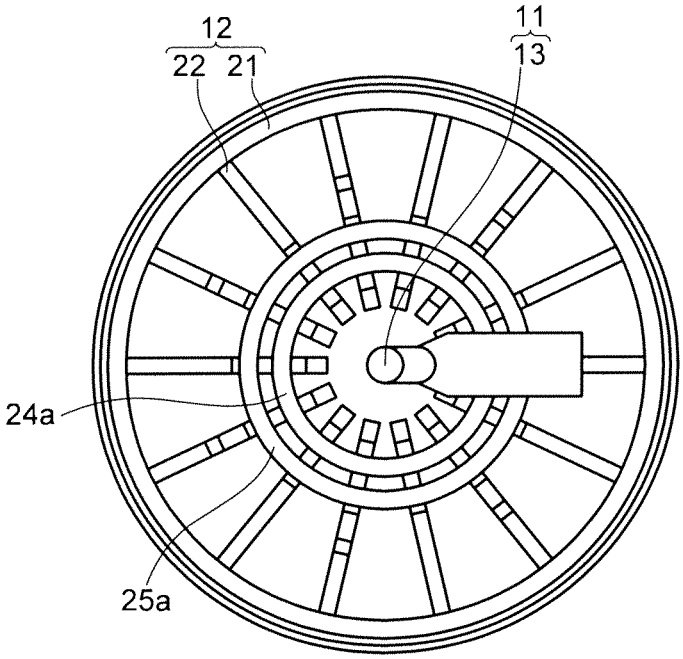
FIG. 32 is a top view illustrating an anode part and a cathode part of the electromagnetic wave generator in the third embodiment.

FIG. 32 illustrates an electromagnetic wave generator 2 having 14 anode resonant plates 22. An increase in the number of division of the anode resonant plates 22 increases the density per unit of high frequency electric field between the resonant plates, so that the electronic efficiency improves. Further, an increase in the number of division of the anode resonant plates 22 decreases the allowable value of the flowing induced current. These enable increase in output efficiency of the microwave in a low current region and a low input power region. However, in the case of using 14 or more anode resonant plates 22, the number of electrons per unit of constitutional spoke decreases, so that the anode current decreases and may fail to perform stable oscillation on a high-input power side.

To perform stable oscillation on a high-input power side, it is preferable to decrease the anode inside diameter (2 ra) to increase the ratio (rc/ra) between the radius (ra) of the anode inside diameter and the radius (rc) of the cathode outside diameter (2 rc). This makes it possible to improve the input resistance to decrease the anode voltage with respect to the same magnetic field. The rc/ra ratio is preferably 0.500 or more. Further, in the case of using 14 or more anode resonant plates 22, L of the resonator increases and the Q value also decreases. Further, by decreasing the anode inside diameter (2 ra), C of the resonator increases and the Q value further decreases. Therefore, the anode current with which the microwave exhibits the maximum output efficiency can shift to a lower current side.

To further enhance the output efficiency of the electromagnetic wave generator 2 in the input power region in the range of 100 to 500 W, it is preferable to employ the anode part 12 having 14 or more anode resonant plates 22, and more preferable to set the rc/ra ratio to 0.500 or more. The electromagnetic wave generator 2 in Example 3 has 14 or more anode resonant plates 22 and an rc/ra ratio of 0.500 as illustrated in Table 9. On the other hand, the electromagnetic wave generator in Reference Example 3 has a number of the anode resonant plates 22 of 12 and an rc/ra ratio of 0.481, and the electromagnetic wave generator in Comparative Example 5 has a number of the anode resonant plates 22 of 10 and an rc/ra ratio of 0.443. Based on the above-described differences in concrete configuration of the electromagnetic wave generator 2, the input power with which the microwave exhibits the maximum output efficiency is shifted to a lower current side in Example 3 than in Reference Example 3 and Comparative Example 5. The electromagnetic wave generator 2 in Example 3 realizes the configuration that the output efficiency of the microwave in the whole region of the input power in the range of 100 to 500 W is 72% or more.

The thermal electrons ejected from the cathode part 11 are accelerated by the electric field between the cathode part 11 and the anode part 12 to obtain kinetic energy, but perform rotational movement from the influence of the magnetic field perpendicular to the electric field. In the rotational movement, the thermal electrons pass through the tips of the anode resonant plates 22 to cause induced current in the anode part 12. The induced current becomes microwave power. The efficiency of converting the kinetic energy obtained by the electrons from the electric field into microwave power is called an electronic efficiency as described above. The electromagnetic wave generator in Example 3 is high in electronic efficiency though low in anode voltage with respect to a fixed magnetic flux density. In principle, the electronic efficiency increases with a higher magnetic flux density. The electromagnetic wave generator in Example 3 can achieve further enhancement of the efficiency by using the permanent magnets 27*a*, 27*b* having a magnetic flux density of 230 mT or more.

As described above, employment of the anode part 12 having 14 or more anode resonant plates 22 and the permanent magnets 27*a*, 27*b* having a magnetic flux density of 230 mT or more can realize the electromagnetic wave generator 2 having an output efficiency in the whole region of the anode current region of 30 to 200 mA (low current region) of 72% or more as illustrate in Table 8, FIGS. 28 to 29. Further, employment of the electromagnetic wave generator 2 makes it possible to provide the plasma emission device 1 having enhanced total luminous flux and improved efficiency and light control range at light control time as described above.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A plasma emission device, comprising:

an electromagnetic wave generator;

a power source unit supplying power to the electromagnetic wave generator;

a waveguide transmitting an electromagnetic wave emitted from the electromagnetic wave generator;

an antenna receiving the electromagnetic wave transmitted through the waveguide;

an electromagnetic wave focuser which is irradiated with the electromagnetic wave from the antenna; and a light emitting unit having an electrodeless bulb disposed in the electromagnetic wave focuser and filled with a light-emitting material therein, the electrodeless bulb plasma-emitting by the electromagnetic wave being focused by the electromagnetic wave focuser to excite the light-emitting material, wherein the electromagnetic wave generator comprises a cathode part and an anode part surrounding the cathode part, and a maximum output efficiency of the electromagnetic wave to be generated with an input power of 700 W or less in the electromagnetic wave generator is 70% or more, and wherein the electromagnetic wave generator generates the electromagnetic wave in an anode current region of 200 mA or less with respect to the input power, and a maximum output efficiency of the electromagnetic wave in the anode current region is 70% or more.

2. The plasma emission device according to claim 1, wherein a fluctuation rate of an output efficiency of the electromagnetic wave to be generated with an input power of from 150 to 700 W in the electromagnetic wave generator is 15% or less.

3. The plasma emission device according to claim 1, wherein a fluctuation rate of an output efficiency of the electromagnetic wave to be generated in an anode current region of from 50 to 200 mA in the electromagnetic wave generator is 15% or less.

4. The plasma emission device according to claim 1, wherein the electromagnetic wave generator comprises:

the anode part having an anode cylinder, and 12 or more anode resonant plates radially arranged from an inner wall of the anode cylinder toward a tube axis thereof;

the cathode part having a filament disposed along the tube axis of the anode cylinder; and an excitation circuit generating a magnetic field in the tube axis direction of the anode cylinder.

5. The plasma emission device according to claim 4, wherein the excitation circuit includes a permanent magnet having a magnetic flux density of 230 mT or more.

6. The plasma emission device according to claim 1, wherein an output efficiency of the electromagnetic wave to be generated in a whole region of an input power of from 100 to 350 W in the electromagnetic wave generator is 72% or more.

7. The plasma emission device according to claim 6, wherein the electromagnetic wave generator generates the electromagnetic wave in an anode current region of from 30 to 150 mA with respect to the input power, and the electromagnetic wave exhibits a maximum output efficiency with an input power of from 250 to 350 W.

8. The plasma emission device according to claim 1, wherein an output efficiency of the electromagnetic wave to be generated in a whole region of an input power of from 100 to 500 W in the electromagnetic wave generator is 72% or more.

9. The plasma emission device according to claim 8, wherein the electromagnetic wave generator generates the electromagnetic wave in an anode current region of from 30 to 200 mA with respect to the input power, and the electromagnetic wave exhibits a maximum output efficiency with an input power of from 200 to 300 W.

10. The plasma emission device according to claim 1, wherein the electromagnetic wave focuser comprises a focuser main body made of a high dielectric material, and the electrodeless bulb is installed in the focuser main body.

11. An electromagnetic wave generator for supplying an electromagnetic wave to a plasma emission device having an electrodeless bulb, comprising:

an anode part having an anode cylinder, and 12 or more anode resonant plates radially arranged from an inner wall of the anode cylinder toward a tube axis thereof;

a cathode part having a filament disposed along the tube axis of the anode cylinder; and an excitation circuit generating a magnetic field in the tube axis direction of the anode cylinder, wherein a maximum output efficiency of the electromagnetic wave to be generated with an input power of 700 W or less is 70% or more, and wherein the electromagnetic wave is generated in an anode current region of 200 mA or less with respect to the input power.

12. The electromagnetic wave generator according to claim 11, wherein a fluctuation range of an output efficiency of the electromagnetic wave to be generated with an input power of from 150 to 700 W is 15% or less.

13. The electromagnetic wave generator according to claim 11, wherein the excitation circuit includes a permanent magnet having a magnetic flux density of 230 mT or more.

14. The plasma emission device according to claim 4, wherein a ratio (rc/ra) of a radius (rc) of a cathode outside diameter (2 rc) to a radius (ra) of an anode inside diameter (2 ra) is 0.487 or more, wherein the anode inside diameter (2 ra) is an inside diameter of inner end portions of the anode resonant plates.

15. The electromagnetic wave generator according to claim 11, wherein a ratio (rc/ra) of a radius (rc) of a cathode outside diameter (2 rc) to a radius (ra) of an anode inside diameter (2 ra) is 0.487 or more, wherein the anode inside diameter (2 ra) is an inside diameter of inner end portions of the anode resonant plates.

* * * * *